US005472346A

United States Patent [19]

Gray et al.

[11] Patent Number: 5,472,346

[45] Date of Patent: Dec. 5, 1995

[54] SWIVEL JOINT FOR VACUUM CLEANER

[75] Inventors: Steven L. Gray, Johnson City; Peter Hoekstra; Michael F. Martin, both of Bristol; George C. Moyher, Jr., Bluff City, all of Tenn.

[73] Assignee: Electrolux Corporation, Atlanta, Ga.

[21] Appl. No.: 321,918

[22] Filed: Oct. 12, 1994

Related U.S. Application Data

[62] Division of Ser. No. 53,250, Apr. 23, 1993, Pat. No. 5,389,004.

[51] Int. Cl.[6] ..... H01R 4/60

[52] U.S. Cl. ..... 439/23

[58] Field of Search ..... 439/190–192, 439/194, 195, 23

[56] References Cited

U.S. PATENT DOCUMENTS

| | | | |
|---|---|---|---|
| 3,034,085 | 5/1962 | Pauler et al. | 339/16 |
| 3,127,227 | 3/1964 | Edwards | 339/15 |
| 3,258,553 | 6/1966 | Breslin | 200/51 |
| 3,262,718 | 7/1966 | Draudt | 285/7 |
| 3,314,039 | 4/1967 | Opper | 339/15 |
| 3,339,168 | 8/1967 | Belicka et al. | 339/5 |
| 3,393,267 | 7/1968 | Busse | 174/78 |
| 3,407,373 | 10/1968 | Brown et al. | 339/5 |
| 3,470,521 | 9/1969 | Downey | 339/8 |
| 3,534,317 | 10/1970 | Descarries et al. | 339/7 |
| 3,546,656 | 12/1970 | Pritulsky | 339/16 |
| 3,553,629 | 1/1971 | Brown et al. | 339/15 |
| 3,565,464 | 2/1971 | Wolf | 285/7 |
| 3,579,706 | 5/1971 | Hetland | 15/327 |
| 3,588,943 | 6/1971 | Hetland | 15/327 |
| 3,614,705 | 10/1971 | Descarries et al. | 339/8 R |
| 3,636,285 | 1/1972 | Wickham et al. | 200/51 R |
| 3,733,697 | 5/1973 | Wickham et al. | 29/628 |
| 3,992,044 | 11/1976 | Muslin | 285/92 |
| 4,003,616 | 1/1977 | Springer | 339/8 R |
| 4,012,091 | 3/1977 | Westergren | 339/15 |
| 4,018,493 | 4/1977 | Lyman et al. | 339/15 |
| 4,094,535 | 6/1978 | Minton | 285/7 |
| 4,162,370 | 7/1979 | Dunn et al. | 174/47 |
| 4,174,858 | 11/1979 | Brooks | 285/7 |
| 4,316,304 | 2/1982 | Parise et al. | 15/339 |
| 4,345,805 | 8/1982 | Finley et al. | 339/16 R |
| 4,385,790 | 5/1983 | Genoa | 339/16 R |
| 4,473,923 | 10/1984 | Neroni et al. | 15/377 |
| 4,494,270 | 1/1985 | Ritzau et al. | 15/377 |
| 4,550,958 | 11/1985 | Smith | 339/5 R |
| 4,557,535 | 12/1985 | Keane | 339/5 R |
| 4,558,889 | 12/1985 | Gans | 285/7 |
| 4,625,998 | 12/1986 | Draudt et al. | 285/7 |
| 4,634,197 | 1/1987 | Horlacher, Jr. | 339/16 R |
| 4,639,055 | 1/1987 | Keane | 339/16 R |
| 4,652,063 | 3/1987 | Genoa et al. | 339/15 |

(List continued on next page.)

FOREIGN PATENT DOCUMENTS

| | | | |
|---|---|---|---|
| 2507965 | 9/1976 | Germany | 439/23 |
| 60-41899 | 12/1985 | Japan . | |
| 60-41900 | 12/1985 | Japan . | |
| 63-51828 | 3/1988 | Japan . | |
| 63-192413 | 8/1988 | Japan . | |
| 63-129557 | 8/1988 | Japan . | |
| 1-83231 | 3/1989 | Japan . | |
| 1-113014 | 5/1989 | Japan . | |
| 1-69459 | 5/1989 | Japan . | |
| 4-227221 | 8/1992 | Japan . | |
| 4-212323 | 8/1992 | Japan . | |

*Primary Examiner*—William Briggs

*Attorney, Agent, or Firm*—Fish & Neave; Jeffrey H. Ingerman

[57] ABSTRACT

In accordance with the present invention, a handle and wand system for a vacuum cleaner is provided which includes an enclosed electrical system which may be used to provide electrical power to a powered floor nozzle or other powered nozzles. The handle and wand system of the present invention may be employed in either a canister vacuum or a central vacuum unit. A swivel elbow is provided to attach the handle and wand system of the present invention to a powered floor nozzle. In another embodiment, an interface is provided easily for attaching, locking and detaching the handle and wand system of the present invention to and from non-powered cleaning tools.

14 Claims, 40 Drawing Sheets

U.S. PATENT DOCUMENTS

| | | | |
|---|---|---|---|
| 4,669,755 | 6/1987 | Harris et al. | 285/7 |
| 4,684,179 | 8/1987 | Freeman | 439/27 |
| 4,720,890 | 1/1988 | Jacob | 15/323 |
| 4,747,621 | 5/1988 | Gans et al. | 285/7 |
| 4,758,170 | 7/1988 | Hayden | 439/142 |
| 4,787,117 | 11/1988 | Westergren | 15/339 |
| 4,804,333 | 2/1989 | Genoa et al. | 439/191 |
| 4,826,444 | 5/1989 | Genoa et al. | 439/191 |
| 4,836,580 | 6/1989 | Farrell | 285/24 |
| 4,881,909 | 11/1989 | Blackman | 439/191 |
| 4,894,021 | 1/1990 | Holden et al. | 439/191 |
| 4,895,528 | 1/1990 | Choiniere et al. | 439/191 |
| 4,915,640 | 4/1990 | Hayden | 439/191 |
| 4,940,415 | 7/1990 | Westergren | 439/192 |
| 4,941,689 | 7/1990 | Sjöberg | 285/7 |
| 4,963,100 | 10/1990 | Genoa et al. | 439/191 |
| 4,969,837 | 11/1990 | Genoa et al. | 439/191 |
| 5,004,428 | 4/1991 | Hayden | 439/191 |
| 5,007,839 | 4/1991 | Holden et al. | 439/191 |
| 5,039,133 | 8/1991 | Albrecht | 285/7 |
| 5,042,844 | 8/1991 | Iida et al. | 285/7 |
| 5,054,156 | 10/1991 | Watanabe et al. | 15/325 |
| 5,063,634 | 11/1991 | Häfele et al. | 15/377 |
| 5,101,534 | 4/1992 | Watanabe et al. | 15/377 |
| 5,109,568 | 5/1992 | Rohn et al. | 15/410 |

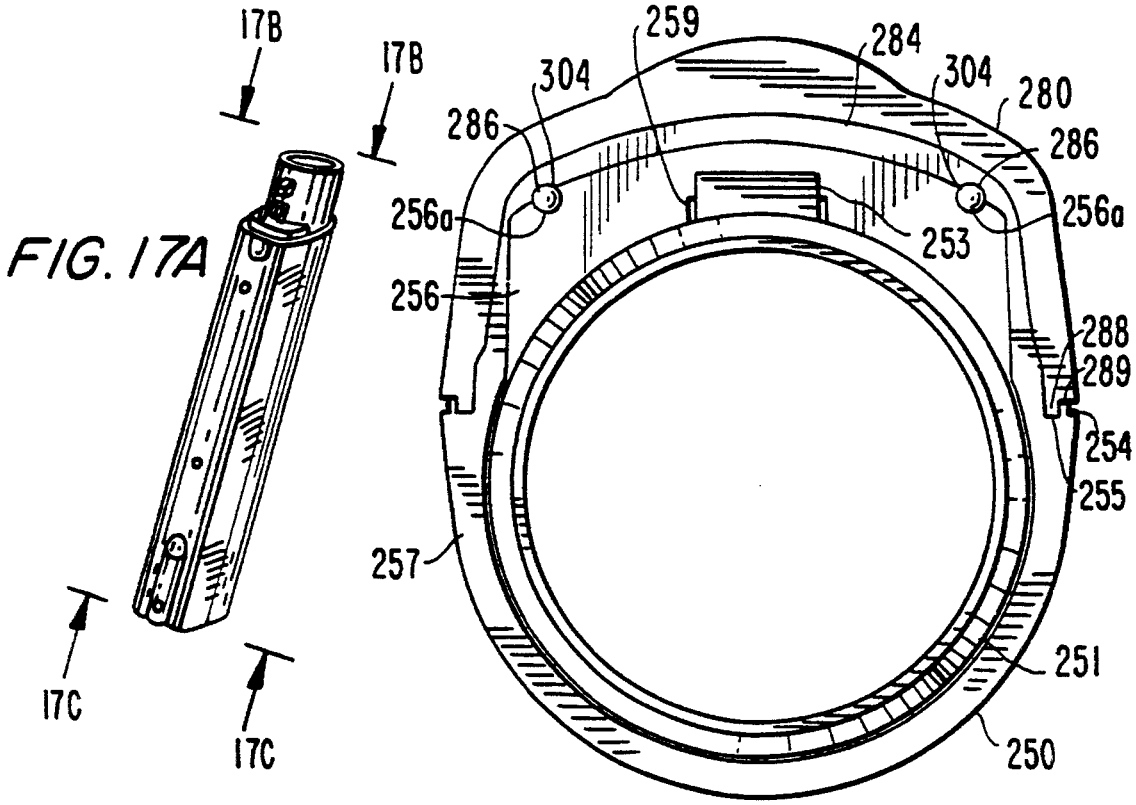
FIG. 17A
FIG. 17B
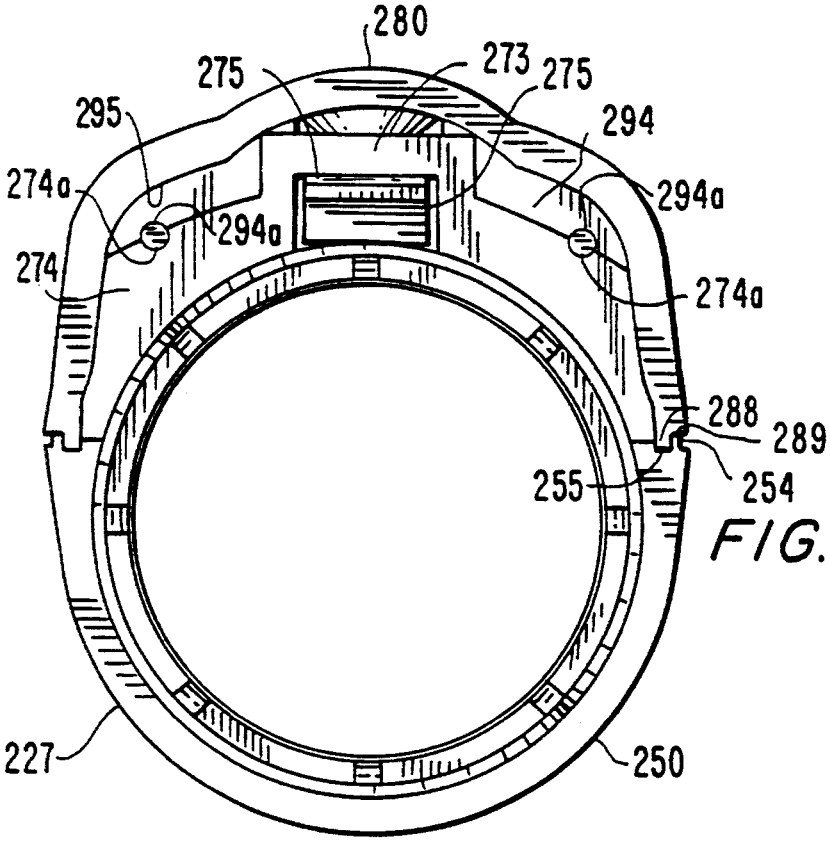
FIG. 17C 30
584
588
586
582
570
580
583

30
580
31B
582
570
31B

SWIVEL JOINT FOR VACUUM CLEANER

This is a division of application Ser. No. 08/053,250, filed Apr. 23, 1993 entitled HANDLE AND WAND SYSTEM FOR VACUUM CLEANER, now U.S. Pat. No. 5,389,004

BACKGROUND OF THE INVENTION

The present invention relates to cleaning devices, and particularly cleaning devices employing a vacuum to clean floors and other surfaces.

SUMMARY OF THE INVENTION

It is an object of this invention to provide a handle and wand system for use with a canister vacuum or a central vacuum cleaner system. The handle and wand system interfaces with a number of different cleaning tools, including a powered floor nozzle, a powered nozzle for use in above-the-floor cleaning, a dusting brush, a crevice tool and several non-powered floor nozzles.

A further object of the present invention is to provide a handle and wand system for use with powered nozzles which do not have any externally visible electrical wires.

In accordance with the present invention, a handle and wand system for a vacuum cleaner is provided which includes an internal electrical system which may be used to provide electrical power to a powered floor nozzle or other powered nozzles.

In one embodiment, the system includes a handle and suction hose assembly which permits the hose, which includes conducting wires, to be freely rotated while attached to the handle.

In another embodiment, means are provided for easily attaching, locking and detaching the components of the handle and wand system of the present invention while providing both a vacuum seal and a plurality of low resistance electrical contacts between the elements of the system of the present invention.

In a further embodiment, a swivel elbow is provided to attach the handle and wand system of the present invention to a powered floor nozzle. The swivel elbow permits both pivoting and steering action while maintaining a plurality of reliable low resistance electrical contacts between the powered floor nozzle and the handle and wand system of the present invention. The steering action enables the powered floor nozzle to be more easily maneuvered.

In another embodiment, an interface is provided easily for attaching, locking and detaching the handle and wand system of the present invention to and from non-powered cleaning tools.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 17A is a perspective view of a wand which may be used in the system of the present invention;

FIG. 17B is an end view of the male end of the wand shown in FIG. 17A;

FIG. 17C is an end view of the female end of the wand shown in FIG. 17A;

DETAILED DESCRIPTION OF THE INVENTION

Figure 1:
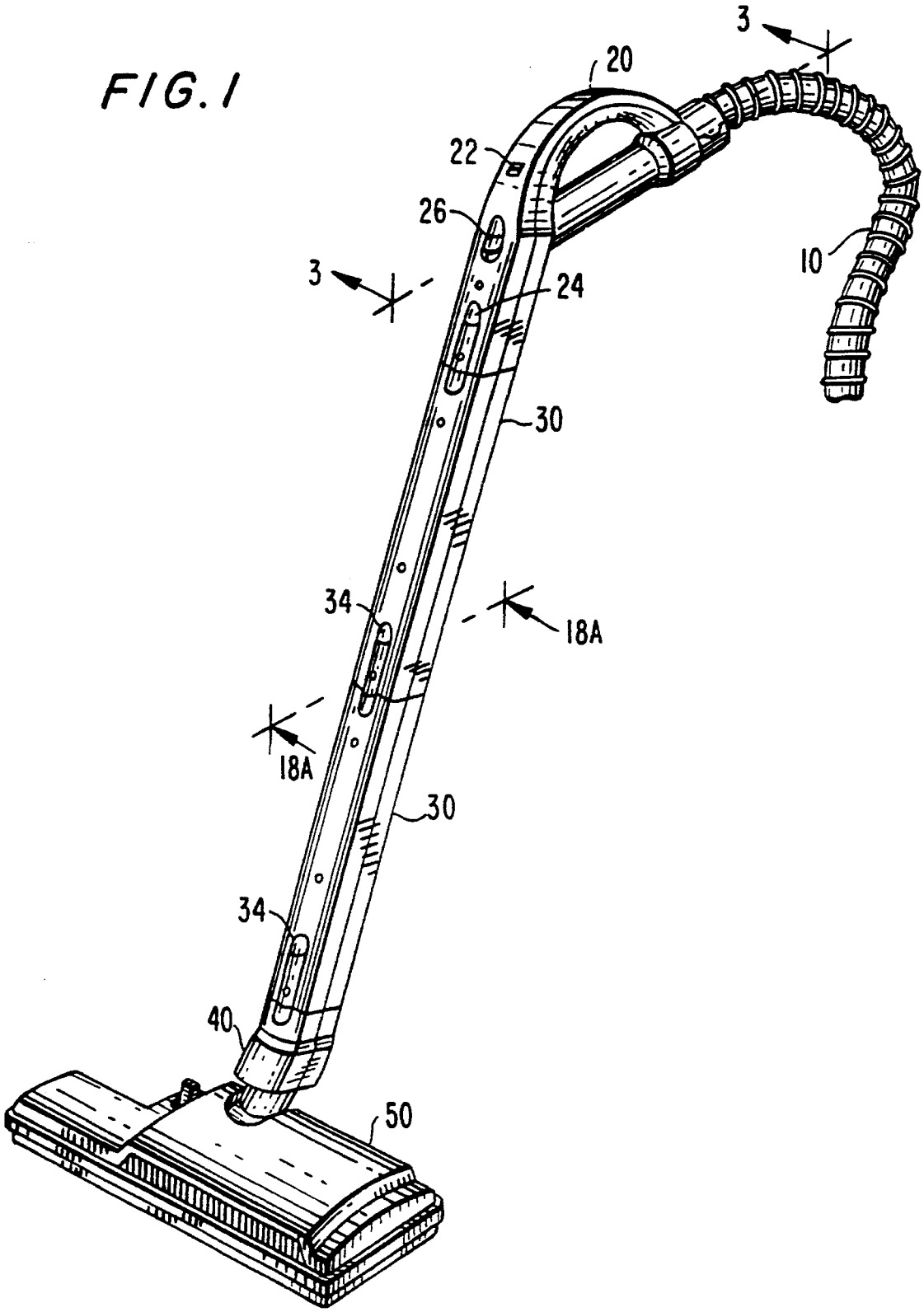
FIG. 1 is a perspective view of an embodiment of the handle and wand system of the present invention, which is shown attached to a floor nozzle.

The handle and wand system of the present invention is generally shown in FIG. 1. Suction hose 10 is connected to a source of suction not shown in FIG. 1, which may be a canister vacuum or a central vacuum system. Suction hose 10 includes at least two conducting wires, which are connected to a power supply. Suction hose 10 is attached to handle 20, which includes on/off switch 22 and air purge slide valve 26. Slide valve 26 slides along the length of handle 20 to open or close an opening in the suction conduit in the top of handle 20. Handle 20 is attached to wand 30, which is attached to another identical wand 30. Handle 20 includes latch 24 which locks handle 20 to wand 30. Wands 30 include similar latches 34 which lock wands 30 to other components, such as other wands 30 or to elbow 40. Elbow 40 is also attached to powered floor nozzle 50. As will be described in greater detail below, the conducting wires which supply power to powered floor nozzle 50 are embedded in suction hose 10 and enclosed within handle 20, wands 30 and elbow 40, and thus are not visible in FIG. 1.

Figure 2:
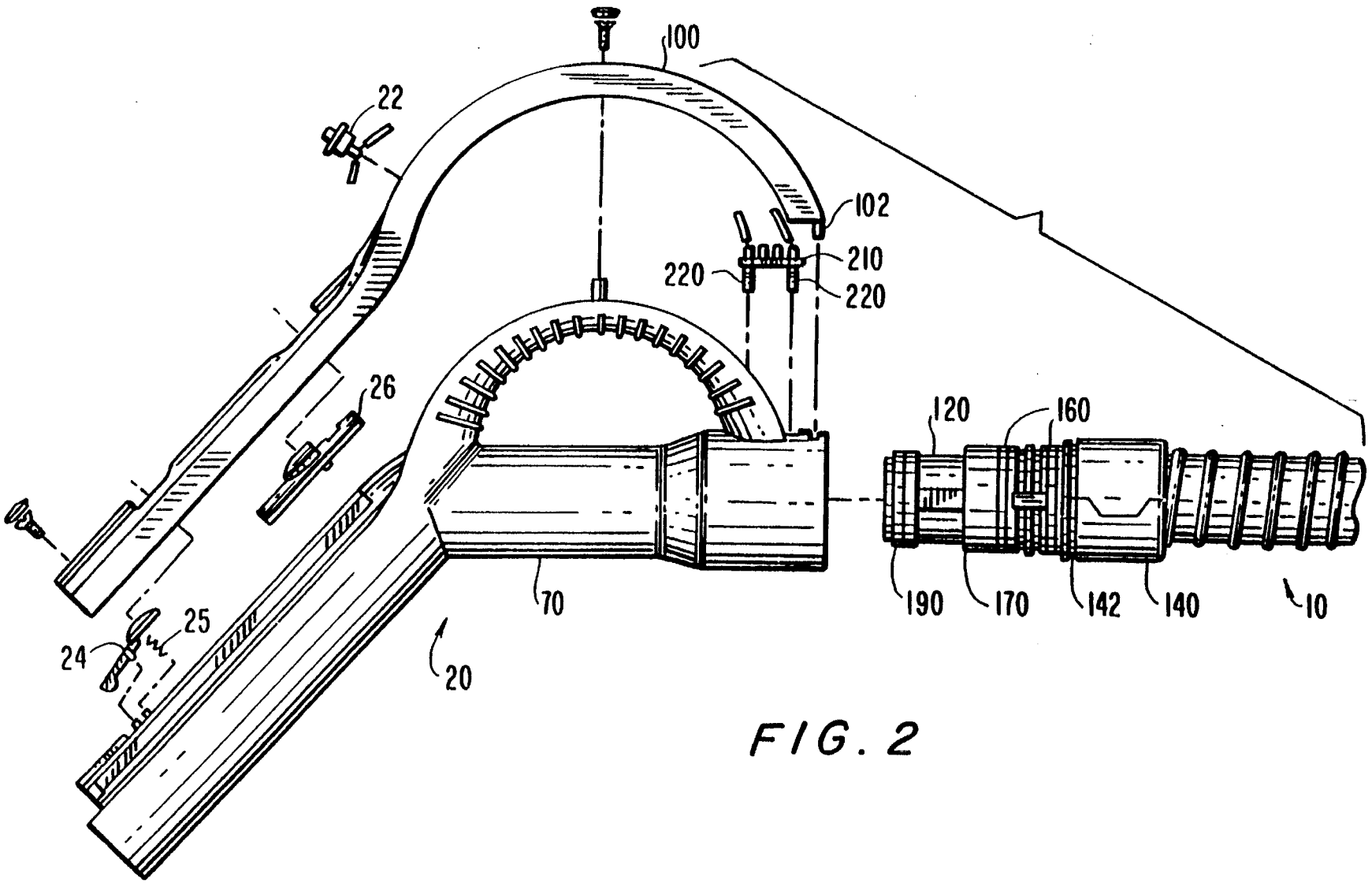
FIG. 2 is an exploded view of an embodiment of the handle of the system of the present invention.
Figure 3:
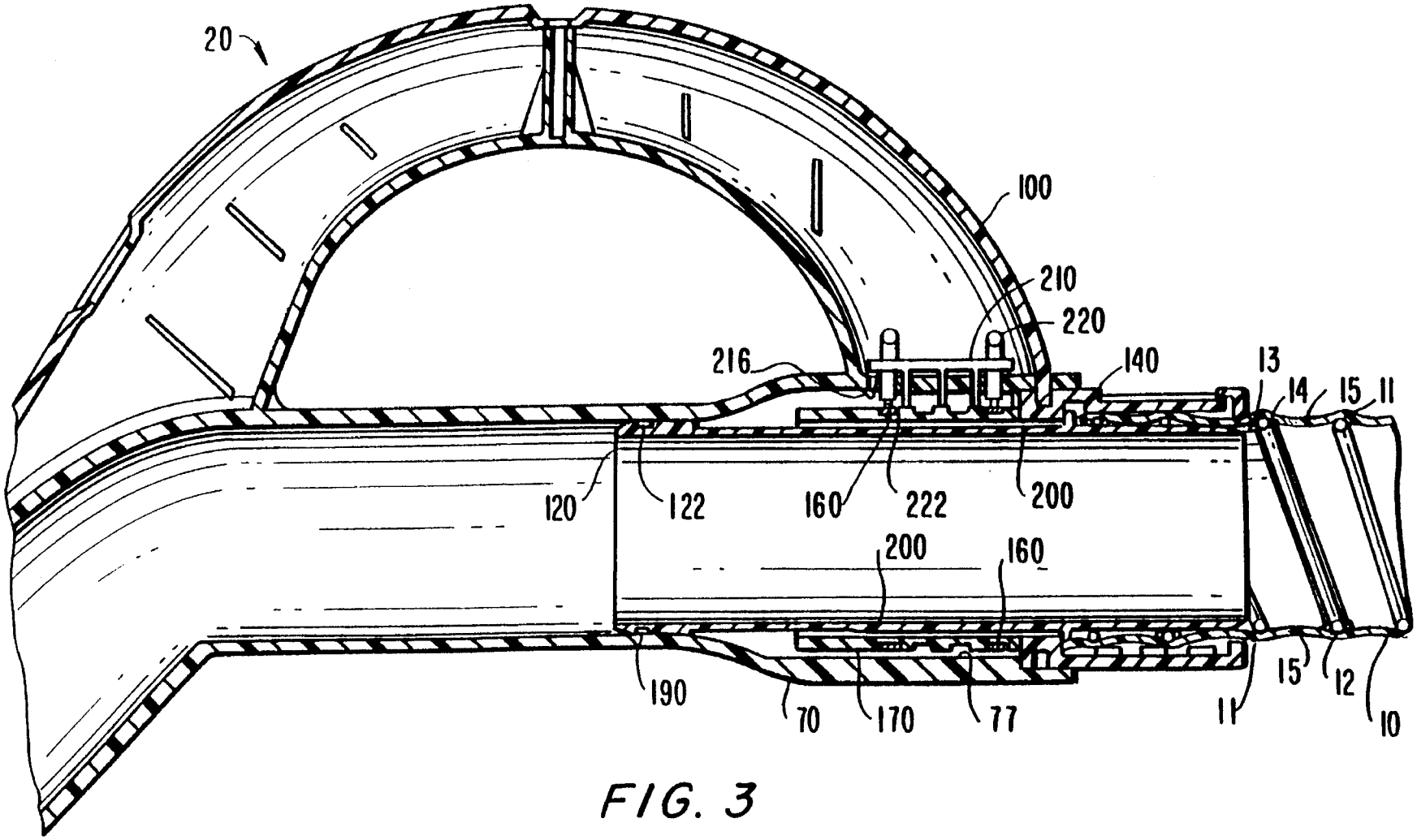
FIG. 3 is a cross-sectional view of an embodiment of the handle of the system of the present invention, which is attaches to a suction hose.

FIG. 2 is an exploded view of handle 20 and suction hose 10 and the means for joining these elements. Reference is also made to FIG. 3, which is a cross-sectional view of the handle and hose assembly. Handle 20 is comprised of a handle body 70 and handle top 100, both of which are preferably molded of acrylobutyldiene styrene (ABS) plastic. Suction hose 10 is attached to the rear of handle body 70 using tube support 120 and cuff 140. Slip rings 160 and slip ring insulator 170 enclose tube support 120. Mylar lead insulator 200 is located between tube support 120 and slip ring insulator 170. Vacuum seal 190, which is preferably made of a linear low density polyethylene (LLDPE) slips over the front end of tube support 120 into groove 122 in tube support 120 as will be described below. Contact board 210 snaps into handle body 70 and is held in place by means of locking arms 216 (shown in FIG. 3). Slip ring contacts 220 are molded in contact board 210. Slip ring contacts 220 include contact tips 222 which are spring biased against slip rings 160 as will be more fully described below.

As shown in FIG. 3, suction hose 10 includes two reinforcing wires 11 and 12 directly opposite one another. Two electrically conducting wires 13 and 14 are located on either side of reinforcing wire 12. Electrically conducting wires 13 and 14, both of which are insulated wires, are preferably coupled to a standard 120 volt AC power source via the canister vacuum (in which case there will only be two conducting wires in suction hose 10).

Additional conducting wires (not shown in any of the FIGS.) may also be embedded in suction hose 10. For example, if the handle and wand system of the present invention is employed in a central vacuum unit, two additional conducting wires may be embedded in suction hose 10 to enable the central vacuum to be turned on and off via switch 22. These two additional conducting wires may be added on either side of reinforcing wire 11. As in the canister vacuum embodiment described above, conducting wires 13 and 14 will again be coupled to a standard 120 volt AC power source via the central vacuum unit.

Figure 4:
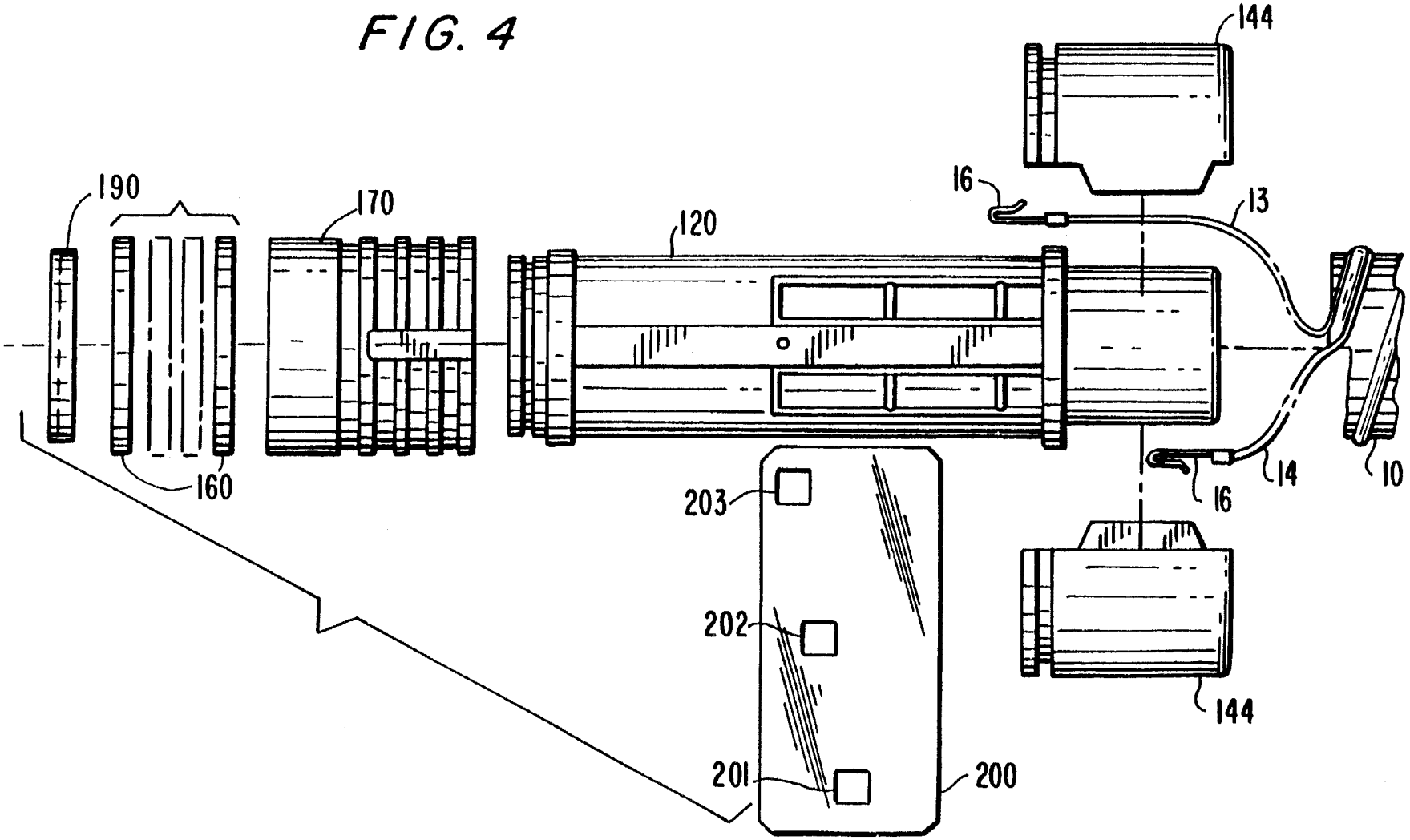
FIG. 4 is an exploded view of a suction hose/tube support/slip ring assembly in an embodiment of the system of the present invention.

FIG. 4 shows an exploded view of the suction hose and slip ring assembly. Suction hose 10 is cut in a manner so as to leave predetermined lengths of conducting wires 13 and 14 extending from the end of suction hose 10, as shown in FIG. 4. Electrical connectors 16 are attached to wires 13 and 14 as shown in FIG. 4.

Figure 5B:
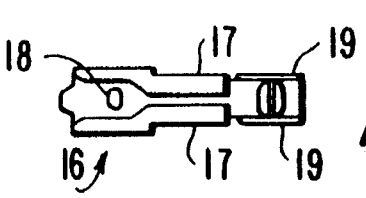
FIGS. 5A and 5B are side and top views of an electrical connector which may be used in the system of the present invention.
Figure 5A:
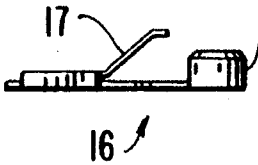

Electrical connectors 16, which are shown in detail in FIGS. 5A and 5B, include contact leaves 17, mounting hole 18 and crimping tabs 19. Electrical connector 16 may, for example, be part number 61462-1 available from AMP Inc. of Harrisburg Pa., or any similar part where contact leaves 17 are of sufficient length and strength so as to contact slip ring 160 in the configuration described herein. Crimping tabs 19 are bent to clamp ends of wires 13 and 14 from which the insulation has been removed to make electrical contact between the a wire and electrical connector 16. Electrical connectors 16 are preferably made of phosphor bronze.

Figure 6A:
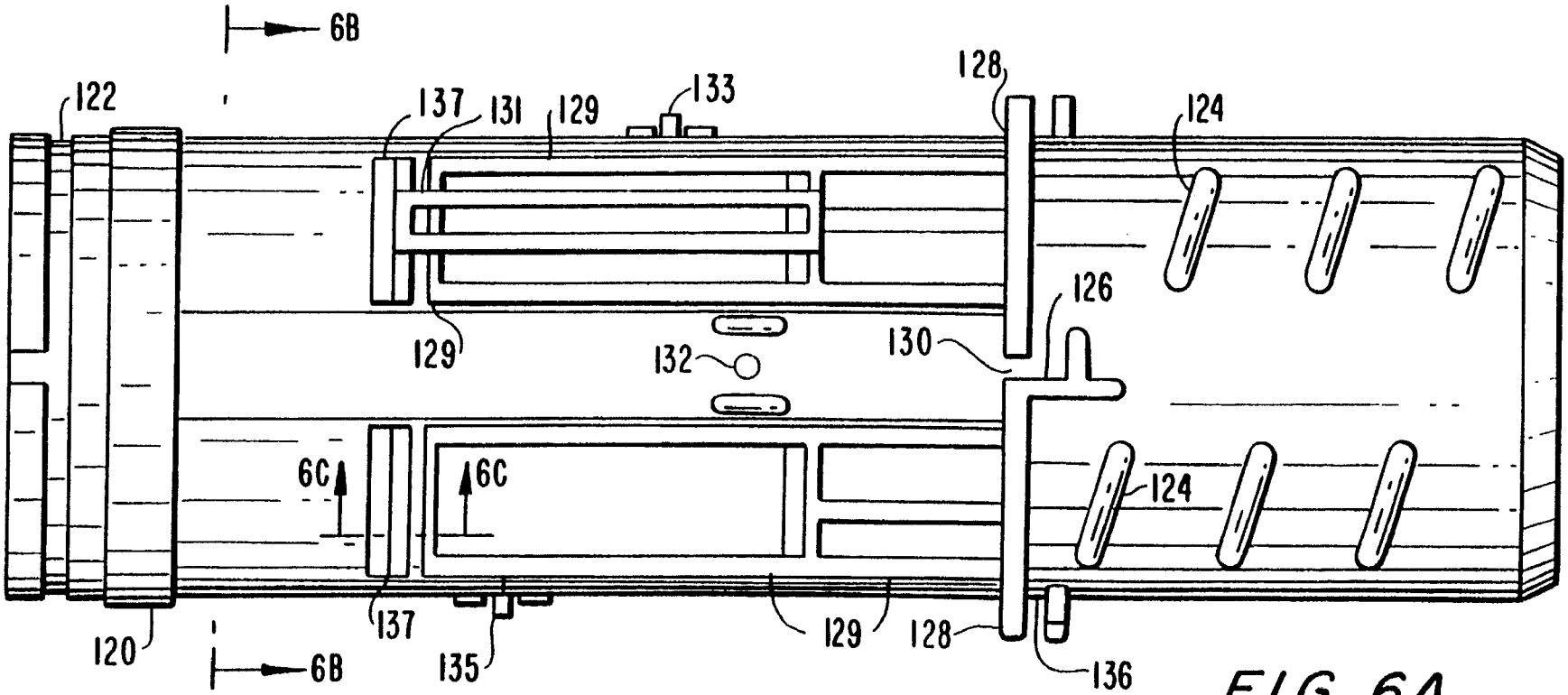
FIG. 6A is a side view of a tube support member which may be used in the system of the present invention.

Electrical connectors 16 attached to conducting wires 13 and 14 are mounted to tube support 120. Tube support 120, which is shown in detail in FIGS. 6A through 6C, has one end having raised thread guides 124 designed to receive suction hose 10. Suction hose 10 is threaded onto tube support 120 with raised thread guides 124 sliding along the valleys 15 of suction hose 10 found between reinforcing wires 11 and 12. Suction hose 10 is threaded onto tube support 120 until the cut end of reinforcing wire 12 abuts raised stop wall 126. Conducting wire 13 is then passed through gap 130 in rim 128 and the electrical connector 16 which is attached to wire 13 is mounted to support tube 120. Mounting hole 18 is then pressed onto first mounting post 132 with connector 16 oriented lengthwise along tube support 120 such that crimping tabs 19 are nearest the suction hose end of tube support 120 and such that contact leaves 17 extend outward from tube support 120.

The electrical connector 16 attached to conducting wire 14 is similarly mounted to fourth mounting post 135, with conducting wire 14 extending approximately one-fourth of the way around tube support 120 along rim 128 and passing through gap 136. Conducting wire 14 then passes around the end of rim 128 (which shown at the bottom of FIG. 6B) and then extends along tube support 120 toward fourth mounting post 135. The electrical connectors 16 attached to conducting wires 13 and 14 (which lead to a 120 V power source) are preferably mounted to the first and fourth mounting posts (132 and 135) so as to provide a substantial distance between the slip rings 160 Which the respective electrical connectors 16 will contact.

Figure 6B:
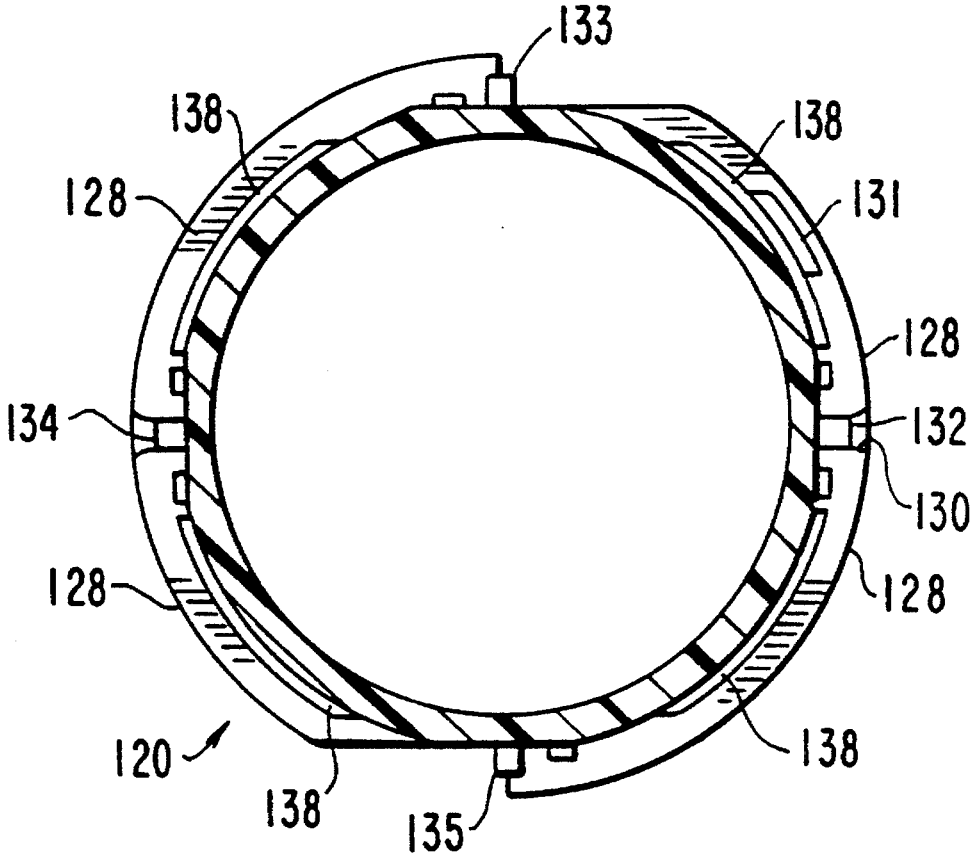
FIG. 6B is a cross-sectional view of the tube support member shown in FIG. 6A.

As noted above, suction hose 10 may include more than two embedded conducting wires. Tube support 120 contains two additional mounting posts. The second mounting post 133 is shown in FIG. 6; the third mounting post 134 (shown in FIG. 6B) is located on support tube 120 opposite first mounting post 132. The opposite side of tube support 120 also includes another stop post and the gaps described above. Thus two more electrical connectors may be attached to support tube 120 and their respective wires configured as described above. It will be clear to those of ordinary skill in the art that tube support 120 could be easily modified to permit more than four wires to be employed, if such wires were embedded in suction hose 10.

Each of the mounting posts 132, 133, 134 and 135 on support tube 12 is located a different distance from the end of support tube 120 to which suction hose 10 is attached. First mounting post 132 is the closest to the hose end of tube support 120; fourth mounting post 135 is the farthest from the hose end of tube support 120. As will be discussed in greater detail below, this spacing permits the contact leaves 17 of the respective electrical connectors 16 mounted to support tube 120 to contact the underside of a different slip ring 160.

Tube support 120 also includes a key 131 having angled side walls, which is best shown in FIG. 6B. As will be discussed below, key 131 is used to guide slip ring insulator 170 (with slip rings 160 positioned thereon) onto tube support 120. Slip ring insulator 170 is supported off the surface of tube support 120 by leading supports 137 and supports 129.

Figure 6C:
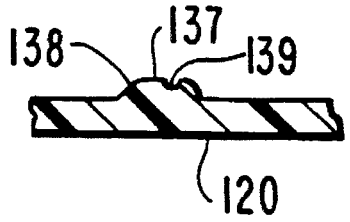
FIG. 6C is a cross-sectional view of a portion of the tube Support member shown in FIG. 6A.

As shown in FIG. 6C, which is a cross-sectional view of a leading support 137 on tube support 120, the forward edge 138 of leading supports 137 is ramped. Leading supports 137 also include a groove 139. Groove 139 is used to lock slip ring insulator 170 (with slip rings 160 positioned thereon) onto tube support 120 in the proper position, as will be discussed below.

Lead insulator 200, which is shown in FIG. 4, provides an additional layer of insulation between insulated wire 14 (and any additional wires from hose 10 which run along the side of tube support 120) and slip rings 160, as shown in FIG. 3. As noted above, lead insulator 200 may be a sheet of Mylar. If a Mylar sheet is used, it will preferably have a thickness of approximately 0.005 inches. Lead insulator 200 includes three windows 201, 202 and 203 cut therein. After the electrical connectors 16 for conducting wires 13 and 14 (and any other wires) are attached to the various mounting posts on tube support 120, lead insulator 200 is wrapped around tube support 120, such that the contact leaves 17 of the electrical connectors 16 attached to the mounting post 133, 134, and 135 protrude through windows 201, 202 and 203, respectively. The crimping tabs 19 of the electrical connectors 16 attached to mounting posts 133, 134 and 135 are preferably covered by lead insulator 200.

Lead insulator 200 preferably extends only slightly more than half of the way around tube support 120, with its longitudinal ends being located near mounting posts 133 and 135. Lead insulator 200 preferably shields conducting wire 14 and any other wires from hose 10 which may be attached to mounting posts 133 and 134 from slip rings 160. Conducting wire 13 need not be shielded by lead insulator 200 because it does not pass under any of slip rings 160.

Figure 7B:
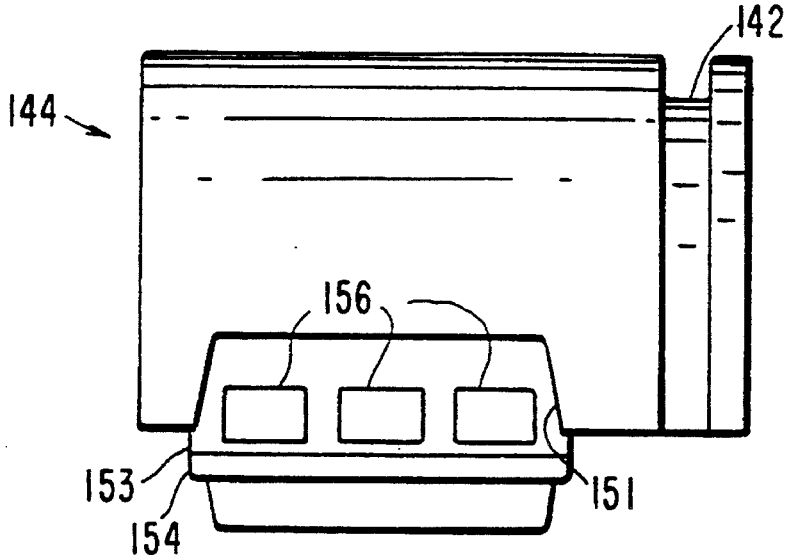
FIG. 7B is a top view of the hose cuff shown in FIG. 7A.

Suction hose 10 is permanently attached to tube support 120 by means of hose cuff 140, which has a groove 142 extending entirely around its outer surface. Hose cuff 140 is comprised of two identical cuff halves 144, which are preferably made of lubricated nylon (e.g., Du Pont Zytel 101L) . One of cuff halves 144 is shown in detail in FIGS. 7A through 7C.

Figure 7A:
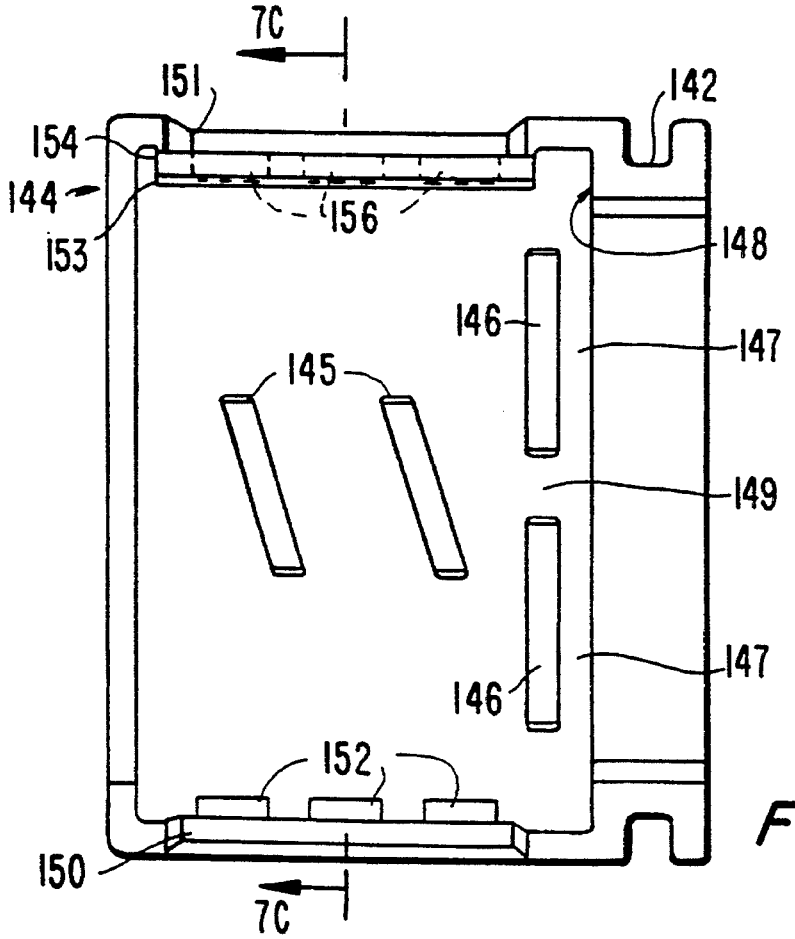
FIG. 7A is a side view of the inside of a hose cuff which may be used in the system of the present invention.

FIG. 7A shows the inside of cuff half 144. Two angled teeth 145 extend inward from the wall of cuff half 144 to line up with the pitch of suction hose 10 and lie in the valleys between reinforcing wires 11 and 12 of suction hose 10 and between raised threads 124 of tube support 120 when cuff half 144 is placed on the suction hose and tube support assembly. Channel 147 is created along the inner wall of cuff half 144 between ridges 146 and rim wall 148. When cuff half 144 is mounted onto tube support 120, rim 128 of tube support 120 rests in channel 147. Similarly, raised stop wall 126 on tube support 120 (or its counterpart on the opposite side of tube support 120) fits into the opening 149 between ridges 146.

Figure 7C:
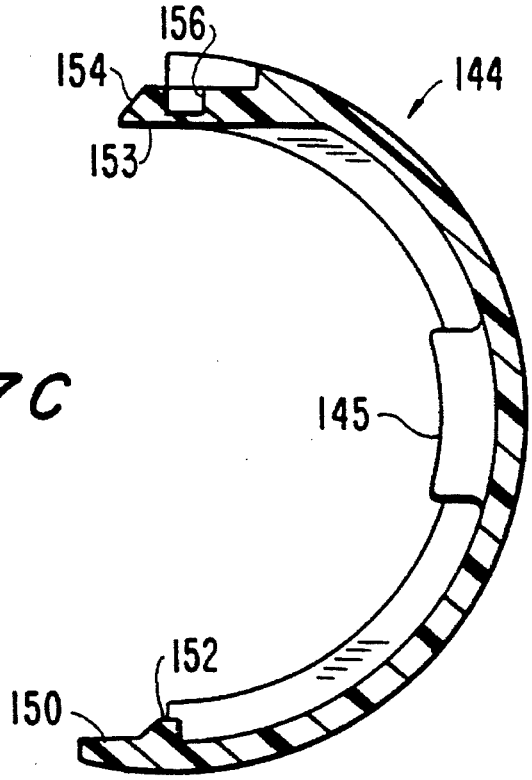
FIG. 7C is a cross-sectional view of the hose cuff shown in FIG. 7A.

Cuff half 144 has an outer tab 150, which is shown at the bottom of cuff half 144 in FIG. 7A (and at the bottom of the cross-sectional view shown in FIG. 7C). Outer tab 150 includes three teeth 152 having ramped leading edges.

Cuff half 144 also has an inner tab 153, which includes a ramped leading edge 154, and is shown at the top of cuff half 144 in FIGS. 7A and 7C. Inner tab 153 extends from the floor of a trapezoid-shaped recess 151, which is best shown in the top view of FIG. 7B. Three rectangular recesses 156 (shown in outline form in FIG. 7A) are cut into the floor of trapezoid-shaped recess 151.

When the two cuff halves 144 are attached to the suction hose and tube support assembly in the manner described above, the outer tab 150 of one cuff half 144 slides over the inner tab 153 of the other cuff half 144 and fits into trapezoid-shaped recess 151. The ramped portions of teeth 152 slide over the ramped leading edge 154 of inner tab 153 until teeth 152 snap into rectangular recesses 156. The elastic pressure from suction hose 10 (which is sandwiched between cuff 140 and the threaded end of tube support 120) forcing inner tab 153 outward against outer tab 150 causes teeth 152 to seat firmly into recesses 156, locking cuff halves permanently onto the suction hose and tube support assembly.

As shown in FIGS. 2, 3 and 4, slip rings 160 are mounted on slip ring insulator 170, which is shown in greater detail in FIGS. SA through 8C. Slip ring insulator 170, which is preferably made of nylon or some other insulating material, is essentially a cylinder with an angled gap in the wall to give it a C-shaped cross-section (as is best shown in cross-sectional view 8B.

Figure 8A:
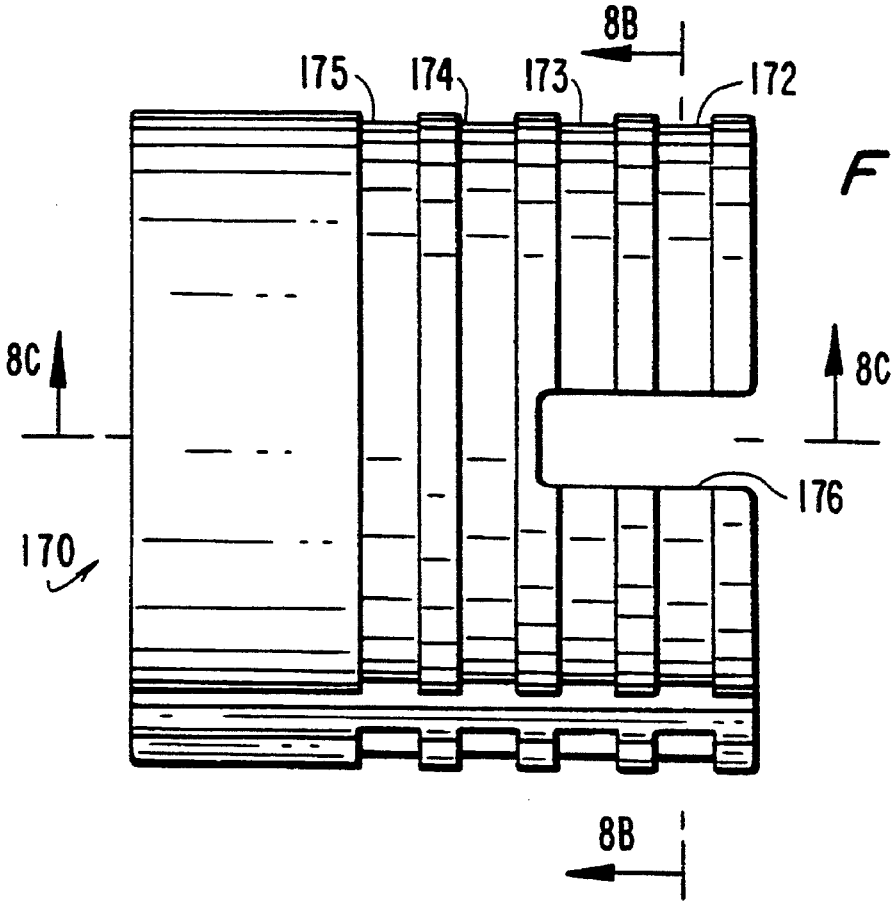
FIG. 8A is a top view of a slip ring insulator which may be used in the system of the present invention.

As is best shown in FIG. 8A, slip ring insulator 170 includes four grooves 172 through 175 running around slip ring insulator 170 into which up to four slip rings 160 seat. (If suction hose 10 includes only two conducting wires, only two slip rings 160 will be required. In this case, these two slip rings would preferably be placed in grooves 172 and 175, so that electrical connectors 16 for conducting wires 13 and 14 can be attached to mounting posts 132 and 135, respectively.)

Figure 8B:
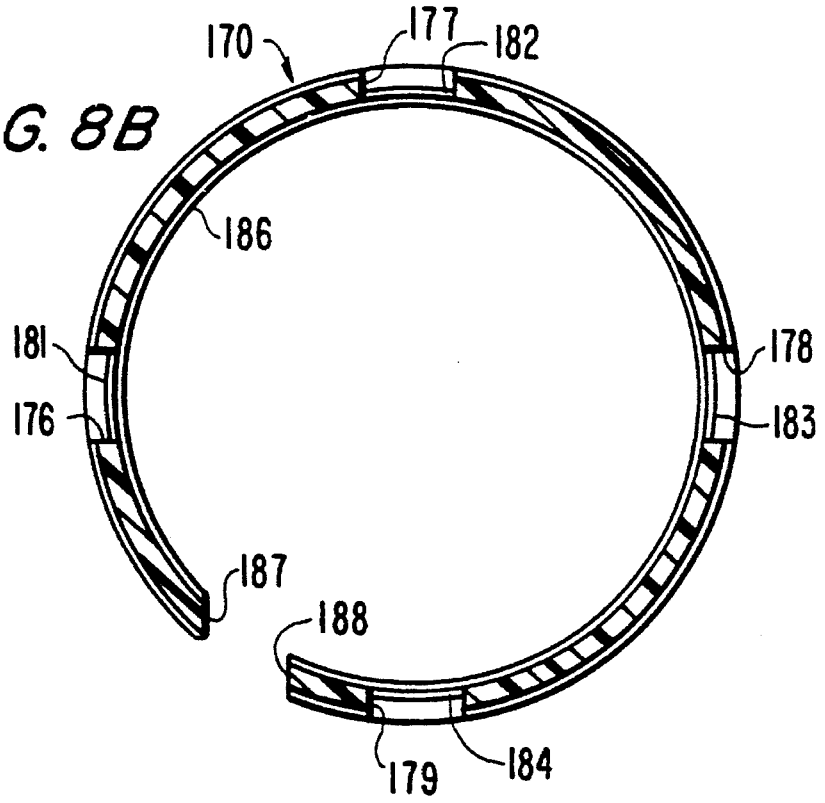
FIG. 8B is a cross-sectional view of the slip ring insulator shown in FIG. 8A.
Figure 8C:
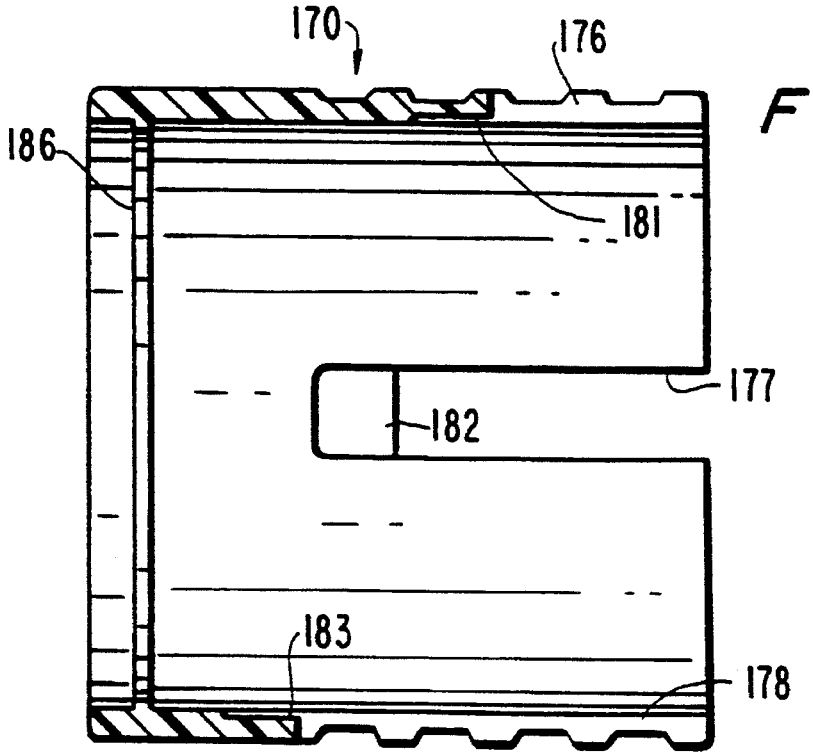
FIG. 8C is a longitudinal cross-sectional view of the slip ring insulator shown in FIG. 8A.

There is one rectangular slot 176, 177, 178 and 179 in slip ring insulator 170 for each of the four grooves 172 through 175. At the end of each rectangular slot 176, 177, 178 and 179 on the inside of slip ring insulator 170 is a square indentation 181, 182, 183, 184. Rectangular slots 176–179 and square indentations 181–184 are best shown in FIGS. 8B and 8C. Each of rectangular slots 176 through 179 extends from the end of slip ring insulator 170 nearest groove 172 to slightly past one of grooves 172 through 175, as shown in FIGS. 8A and 8C. Slip ring insulator 170 also includes a locking rim 186 which extends around its inside, as shown in FIG. 8C. As will be discussed below, rectangular slots 172–175 and square indentations 181–184 provide clearance for electrical connectors 16 when slip ring insulator 170 slides on tube support 120 during assembly.

The angled gap in slip ring insulator 170 is formed by tapered walls 187 and 188, as shown in FIG. 8B. Moreover, the inner diameter of slip rings 160 is preferably slightly less than the outer diameter of grooves 172–175 in slip ring insulator 170. Because of the angled gap in slip ring insulator 170, it can be slightly compressed (by forcing tapered walls 187 and 188 closer together) to permit slip rings 160 to slide over slip ring insulator 170 and into grooves 172 through 175. When the compressive force is released, the force causing tapered walls 187 and 188 apart to their relaxed state will prevent slip rings 160 from unseating from grooves 172 through 175.

Slip ring insulator 170 then slides onto tube support 120 (after lead insulator 200 is in place) as shown in FIG. 4, with the end of slip ring insulator 170 nearest groove 172 sliding onto the end of tube support 120 nearest groove 122. Key 131 on tube support 120 fits snugly into the angled gap between tapered walls 187 and 188 of slip ring insulator 170. Slip ring insulator 170 then slides toward the threaded end of tube support 120 until locking rim 186 on the inside of slip ring insulator 170 passes over the ramped forward edge 138 of leading supports 137 on tube support 120. Locking rim 186 seats firmly in groove 139 to lock slip ring insulator 170 onto tube support 120. Slip ring insulator 170 is thus locked into place and will not move relative to tube support 120.

As noted above, rectangular slots 176–179 on the inside of slip ring insulator 170 provide clearance for electrical connectors 16 mounted to posts 132 through 135 as slip ring insulator 170 is being positioned on tube support 120. Clearance between slip ring insulator 170 and tube support 120 is also provided by leading supports 137 and supports 129 on tube support 120. When slip ring insulator 170 is locked into place, the tops of posts 132 through 135 will be located in square indentations 181 through 184.

When slip ring insulator 170 is locked into place, the contact leaves 17 on electrical connectors 16 attached to mounting posts 132–135 will extend through rectangular slots 176–179 in slip ring insulator 170 and contact the inside of slip rings 160 which are seated in grooves 172–175, respectively (if suction hose 10 contains four conducting wires). The contact leaves 17 of the electrical connectors 16 attached to mounting posts 133–135 will also protrude through openings 201–203 in lead insulator 200. If suction hose 10 has only two conducting wires, only the first and fourth mounting posts (132 and 135) and only two slip rings 160 (seated in grooves 172 and 175) will be used.

Vacuum seal 190, is now seated into groove 122 in tube support 120. This completes the suction hose/tube support/slip ring assembly which will be attached to handle 20 as discussed below.

Figure 9A:
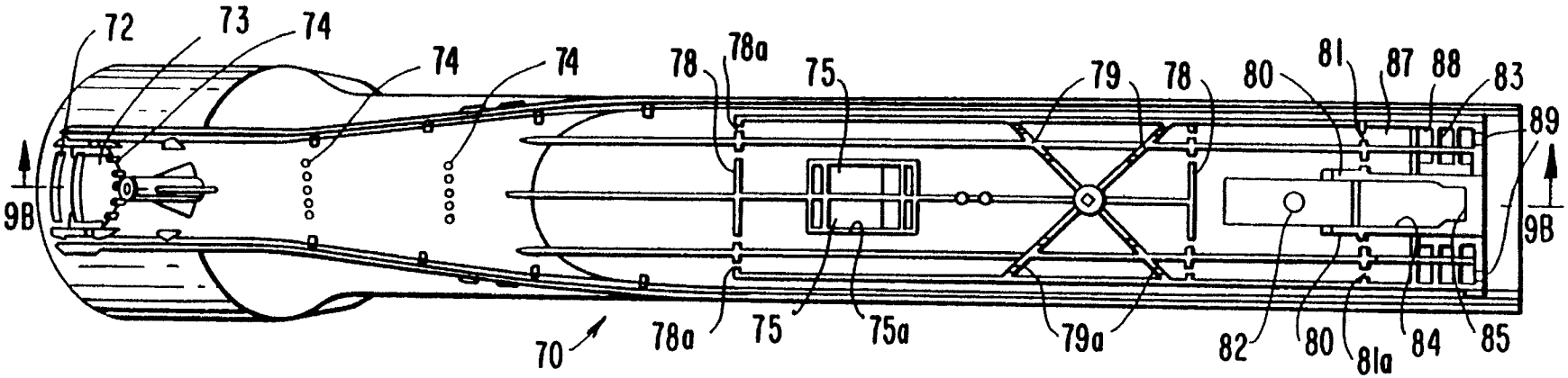
FIG. 9A is a top view of a handle body which may be used in the system of the present invention.
Figure 9B:
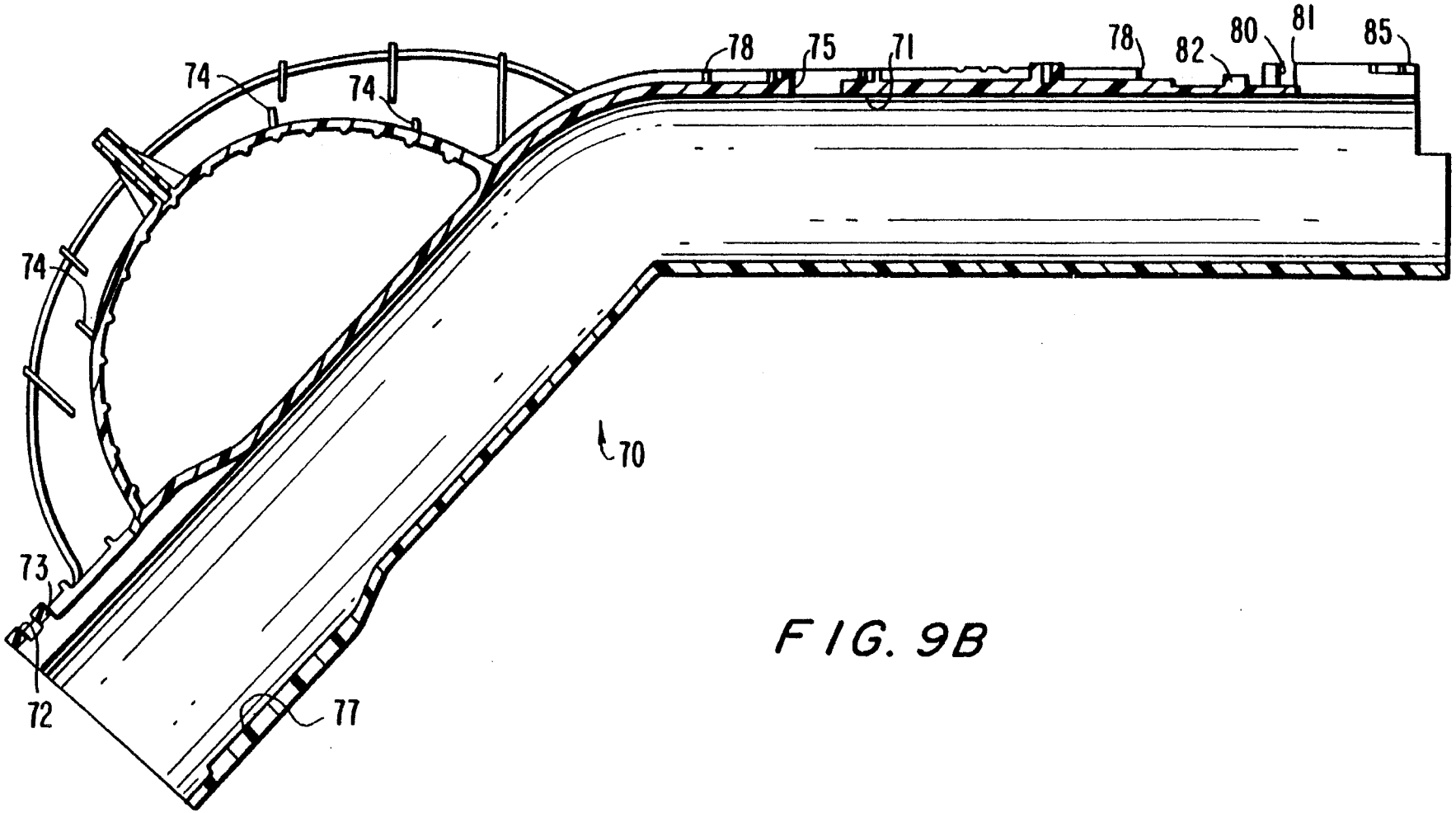
FIG. 9B is a longitudinal cross-sectional view of the handle body shown in FIG. 9A.

As noted above, handle 20 comprises a handle body 70 and handle top 100. Handle body 70 is shown in detail in FIGS. 9A and 9B. FIG. 9A is a top view of handle body 70, whereas FIG. 9B is a side cross-sectional view.

Slot opening 72, which preferably has rounded edges and is utilized in locking handle body 70, handle top 100 and the suction hose/tube support/hose cuff assembly together, is located at the rear end (i.e., the suction hose end) of handle body 70. Generally rectangular opening 73 (which preferably has rounded edges on its forward end) provides an opening for mounting contact board 210 to handle bottom 70. A low stop wall 77 (which can be seen in FIGS. 3 and 9B) extends upward from the bottom of handle body 70.

Three rows of wire holding posts 74 are located along the curved upper portion of handle body 70. As can be seen in FIG. 9A, each row preferably includes five posts, leaving four gaps between the five posts. Each of these gaps preferably spans a distance which is slightly less than the total diameter of any one of the two to four insulated wires which may be employed (depending upon the number of conducting wires included in suction hose 10). Thus a conducting wire can be wedged between two wire holding posts 74 to hold it in place during assembly of handle body 70 to handle top 100 and the suction hose/tube support/hose cuff assembly.

Handle body 70 also includes two wire guides 78, each of which has two gaps 78*a* through which conducting wires pass. As with the gaps between wire holding posts 74, each of gaps 78*a* in wire guides 78 spans a distance which is slightly less than the total diameter of any one of the two to four insulated wires which may be employed. Raised wire guide 81 (having gaps 81*a*) is similar to wire guides 78 except that it extends slightly higher. Raised wire guide 81 also forms the back of rear pockets 87.

Handle body 70 also includes two diagonal walls 79, each of which has gaps 79*a* through which conducting wires pass. Gaps 79*a* preferably have a generally semicircular shape (with the rounded end pointing downward) and are large enough to easily accommodate a conducting wire. As shown in FIG. 9A, diagonal walls 79 surround one of the two screw holes used in fastening handle body 70 to handle top 100.

Figure 34A:
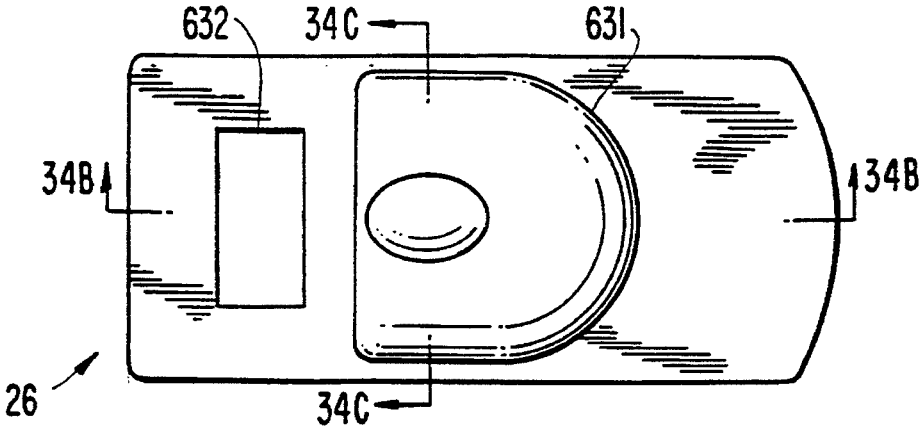
FIGS. 34A 34B and 34C are top, longitudinal cross-sectional and traverse cross-sectional views of a air purge slide valve which may be used in the system of the present invention.
Figure 34B:
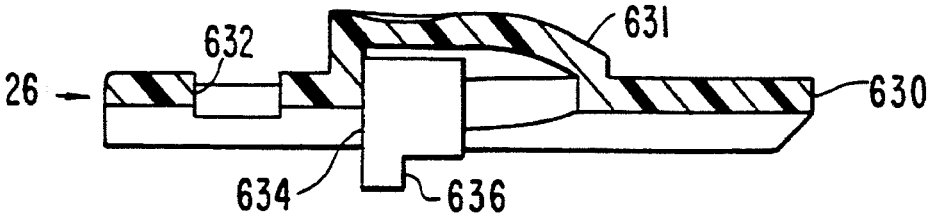
Figure 34C:
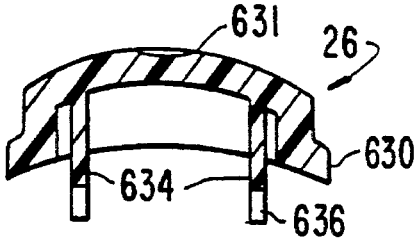

Handle body 70 also includes air purge openings 75 in suction conduit 71 for relieving the vacuum pressure at the nozzle. Air purge openings 75 are surrounded by protruding walls 75*a*. Air purge slide valve 26, which is shown in greater detail in FIGS. 34A (a top view), 34B (a longitudinal cross-sectional view) and 34C (a traverse cross-sectional view), slides over openings 75. As shown in FIGS. 34A through 34C, air purge slide valve 26 comprises an arced body 630, button 631 and rectangular opening 632. Two guide walls 634 extend downward from the underside of air purge slide valve 26. Each guide wall 634 has a square extension 636.

Air purge slide valve 26 is placed over openings 75 in handle body 70 with guide walls 634 fitting loosely inside protruding walls 75*a* and with rectangular opening 632 towards the rear of handle body 70. Square extensions 636 then limit the movement of air purge slide valve 26 over openings 75 by abutting the front and rear walls of openings 75. This permits air purge slide valve 26 to be positioned so that rectangular opening 632 is positioned partially over opening 75 (opening the air purge), entirely over the top of handle body 70 behind openings 75 (closing the air purge), or any position in between.

FIGS. 9A and 9B also show pivot supports 80 for latch 24. Boss 82 is shown near pivot supports 80; the bottom of compression spring 25 (which is shown in FIG. 2) fits snugly around boss 82.

Figure 20A:
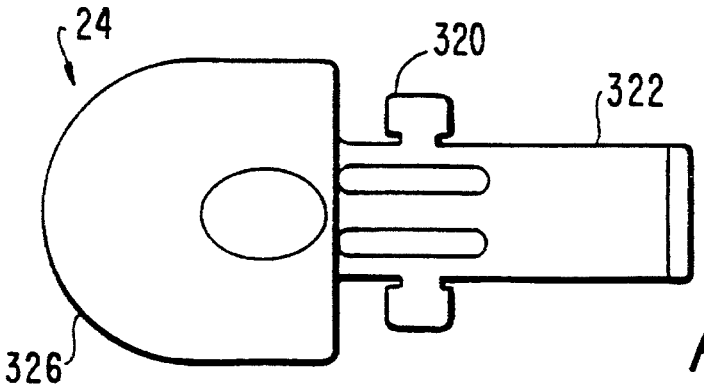
FIGS. 20A, 20B and 20C are top, side and bottom views of a latch which may be used in the system of the present invention.
Figure 20B:
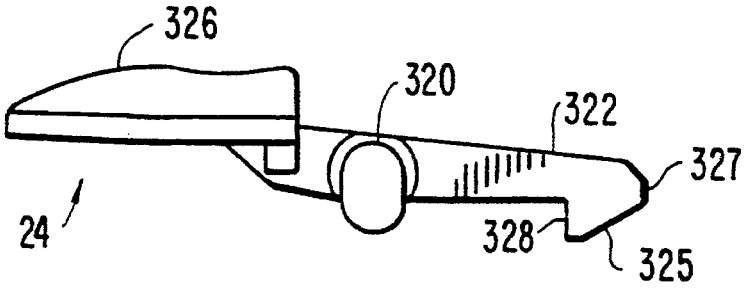
Figure 20C:
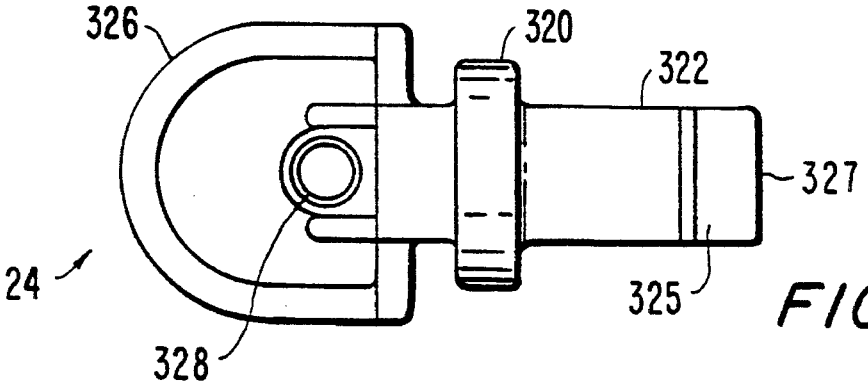

Latch 24 is shown in detail in FIGS. 20A through 20C. FIGS. 20A and 20B are top and side views of latch 24, respectively. Latch 24, which is preferably molded of polycarbonate plastic, includes latch button 326 and locking arm 322. Pivots 320 are attached to the sides of locking arm 322. On the front lower side of locking arm 322 is locking tooth 325, which has a ramped front side 327 and a steep back wall 328. As is shown in the bottom view of latch 24 in FIG. 20C, the underside of latch button 326 has a boss 328 for spring 25.

When latch 24 and spring 25 are placed onto handle body 70, pivots 320 slide into pivot supports 80, while spring 25 is located between bosses 82 and 328. Locking arm 322 of latch 24 extends into slot opening 84 in handle body 70. Raised front rib 85 closes off the front end of opening 74.

Figure 13A:
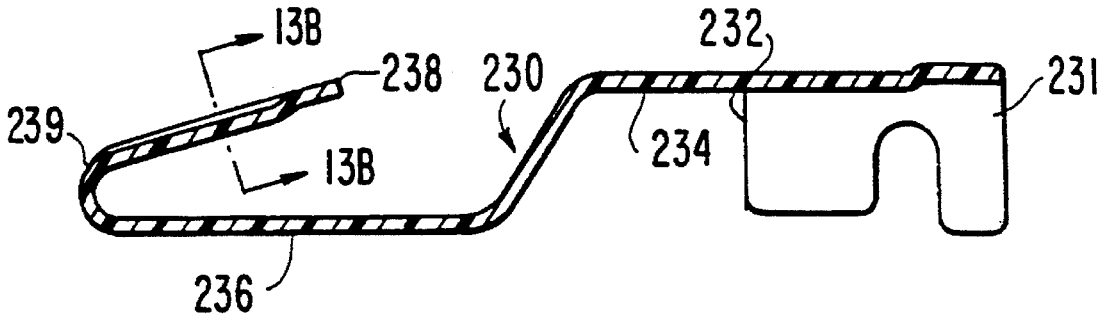
FIG. 13A is a cross-sectional view of a spring terminal which may be used in the system of the present invention.
Figure 13B:
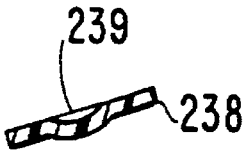
FIG. 13B is a cross-sectional view of the contact leaf of the spring terminal shown in FIG. 13A.
Figure 13C:
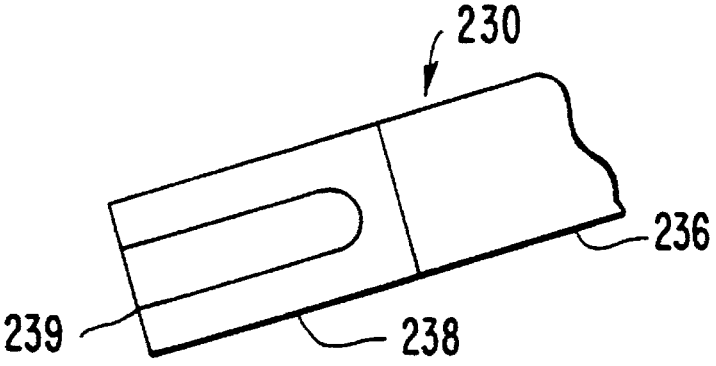
FIG. 13C is a top view of the contact leaf of the spring terminal shown in FIG. 13A.

Handle body 70 also includes rear pockets 87 and front pockets 88, into which spring terminals 230, which are shown in detail in FIGS. 13A through 13C are placed. Front pockets 88 include leveling supports 83. Handle body 70 also includes two semicircular openings 89, which, in conjunction with similar openings 112 in handle top 100, permit pins 304 on wand 30 to make electrical contact with spring terminals 230.

The conducting wires extending along handle body 70 (which are not shown in FIGS. 9A and 9B) are preferably aligned in a generally parallel manner, with, for example one wire passing through the uppermost gap between wire holding posts 74, the uppermost gap 78*a* in wire guides 78, the uppermost gaps 79*a* in diagonal walls 79 and the uppermost gap 81*a* in raised wire guide 81. As will be understood by one of ordinary skill in the art, one conducting wire will lead from a slip ring contact 220 in contact board 210 to one terminal on on/off switch 22; another wire will lead from the other terminal of on/off switch 22 to a spring terminal 230 in the front of handle 20.

Figure 10A:
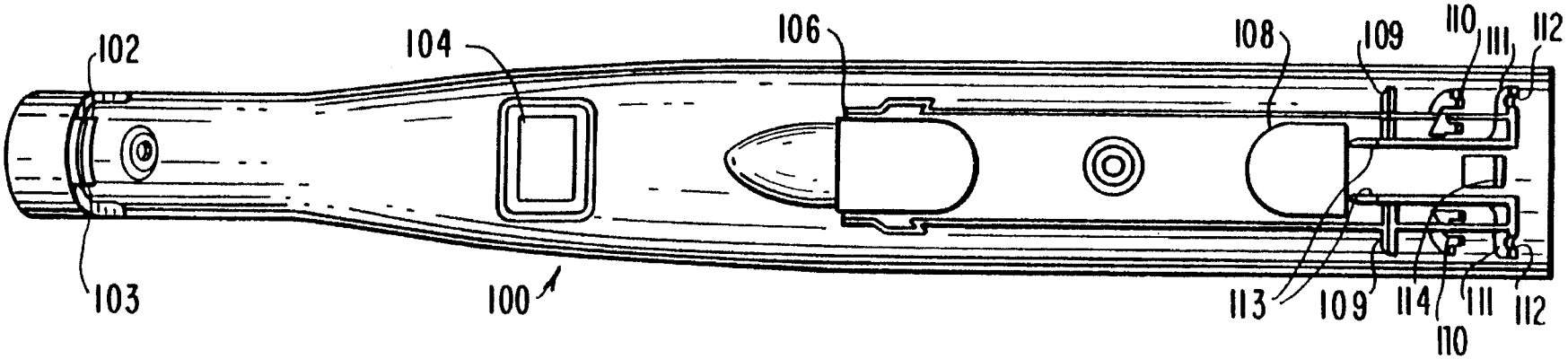
FIG. 10A is a bottom view of the inside of a handle top which may be used in the system of the present invention.
Figure 10B:
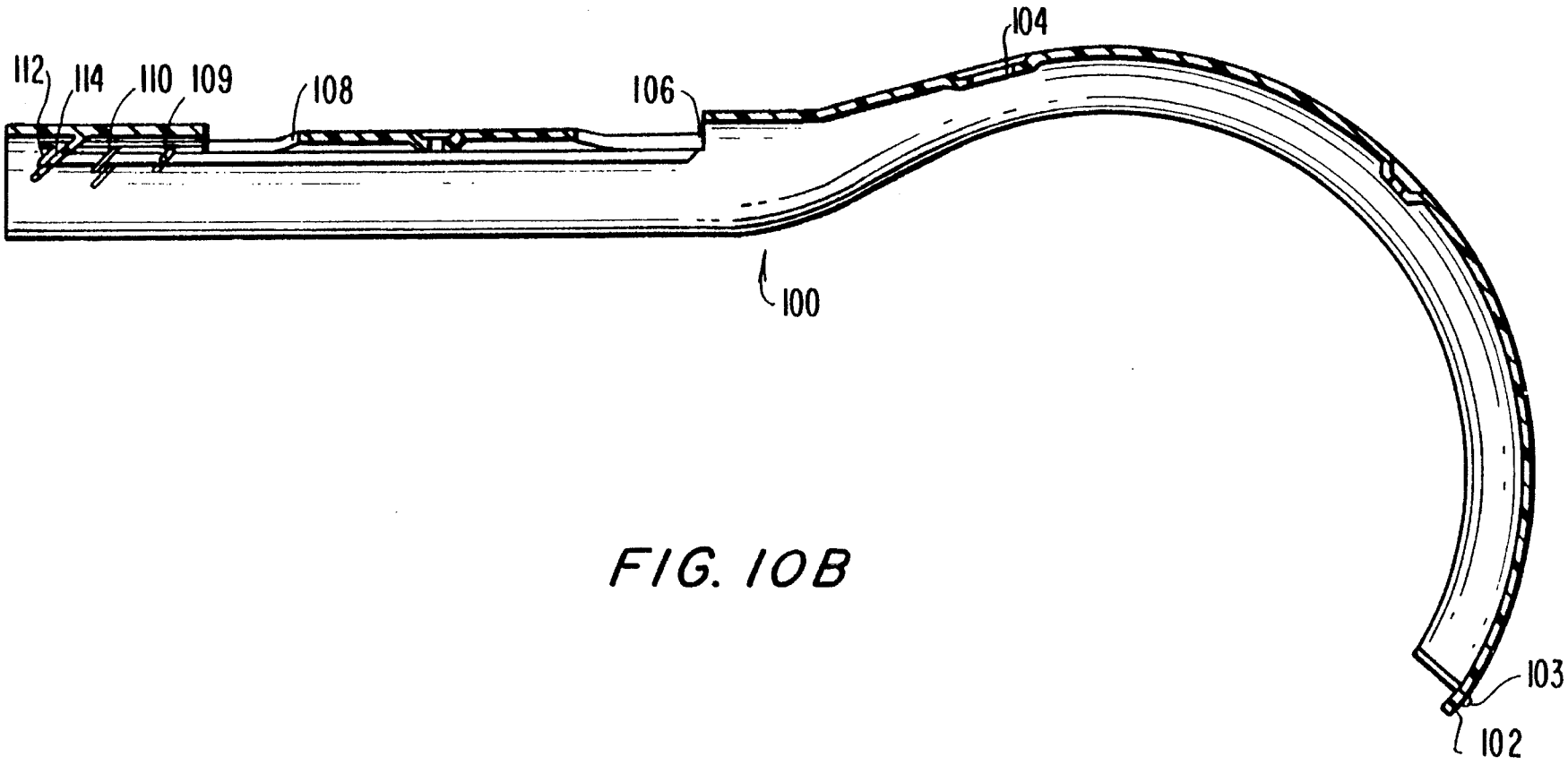
FIG. 10B is a longitudinal cross-sectional view of the handle top shown in FIG. 10A.

A bottom view of the inside of handle top 100 is shown in FIG. 10A, whereas FIG. 10B shows a cross-sectional view of handle top 100. Like the handle body 70, handle top 100 is preferably formed of molded ABS plastic. At the rear of handle top 100 is tab 102. As shown in FIGS. 10A and 10B, an arced rib 103 is located on the rear side of tab 102. Switch opening 104, into which on/off switch 22 fits, is shown at the forward part of the curved handle portion. On/off switch 22 can be any conventional switch, and can be locked in place in opening 104 by any conventional means (e.g., by employing locking teeth, similar to that used to hold contact board 210 to handle body 70.

Handle top 100 includes a slide valve opening 106, which is used to slide air purge slide valve 26 back and forth, as will be clear to one of ordinary skill in the art.

Handle top 100 also includes a latch opening 108, through which latch button 326 protrudes. Directly in front of latch opening 108 are two ribs which include rectangular projections 113. Rear angled walls 109 extend down from the top of handle top 100. When the handle top 100 is joined to the handle body 70, the bottoms of rear angled walls 109 abut the top of raised wire guide 81 to hold wires into the gaps 81*a* in wire guide 81. Angled prongs 110 also extend down from the top of handle top 100, such that when handle top 100 is joined to the handle body 70, the bottoms of angled prongs 109 rest in front pockets 88, holding spring terminals 230 into position.

Handle top 100 also includes forward angled walls 111, each of which includes a semicircular opening 112. When handle top 100 is joined to the handle body 70, the semicircular openings 112 extend down from handle top 100 to abut semicircular openings 89 in the front of handle body 70 to form circular openings to permit pins 304 to contact spring terminals 230. Rectangular projection 113 fit into the open end of pivot supports 80 to lock latch 24 in place.

Angled tow in rib 114 also extends down from handle top 100. After the wires, spring terminals 230, latch 24, spring 25, air purge slide valve 26 and contact board 210 shown in FIG. 2 have been put in place on handle body 70 as shown and described, handle top 100, handle body 70 and the suction hose/cuff/tube support/slip ring assembly are joined as follows. The suction hose/cuff/tube support/slip ring assembly is moved into the rear opening in handle body 70 as shown in FIGS. 2 and 3 until groove 142 in hose cuff 140 is aligned with slot opening 72 in handle body 70. Low stop wall 77 (shown in FIGS. 3 and 9B) may be provided on the inside of handle body 70 to prevent groove 142 in hose cuff 140 from moving past slot opening 72 and thus permit blind alignment of slot opening 72 with groove 142.

Handle top 100 is moved downward and forward along the top of handle body 100 until angled tow rib 114 slides under raised front rib 85 of handle body 70. The rear end (i.e., the curved end) of handle top 100 is then pivoted downward until tab 102 extends down through slot opening 72 and into groove 142 of hose cuff 140 as shown in FIG. 3. Arced rib 103 provides a snap fit for tab 102 by abutting the inside of handle body 70 adjacent to the rear end of slot opening 72. Handle top 100 is then attached to handle body 70 by two screws, as shown in FIG. 2. The screws, which are preferably self tapping, may also be covered by plastic caps (which are not shown in the FIGS.) as desired for aesthetic reasons.

Tab 102 fits into groove 142 such that suction hose 10 is firmly attached to handle 20. Suction hose 10 is free to rotate 360 degrees relative to handle 20, with tab 102 sliding easily in groove 142 in lubricated nylon hose cuff 140. Moreover, slip ring contacts 220 maintain electrical contact with slip rings 160 throughout the entire 360 degrees of rotation.

Figure 11:
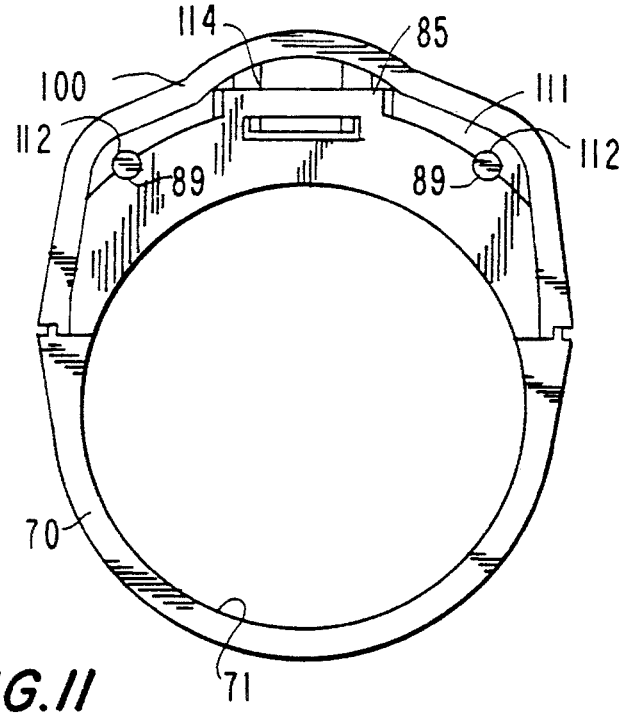
FIG. 11 is an end view of the front end of the frontmost portion of a handle and cover assembly which may be used in the system of the present invention.

A view of the front of handle 20 is shown in FIG. 11. The circular openings for pins 304 are formed by semicircular openings 89 in handle body 70 and the semicircular openings 112 in forward angled wall 111 of handle top 100. Tow in rib 114 is also shown behind raised front rib 85.

Figure 12A:
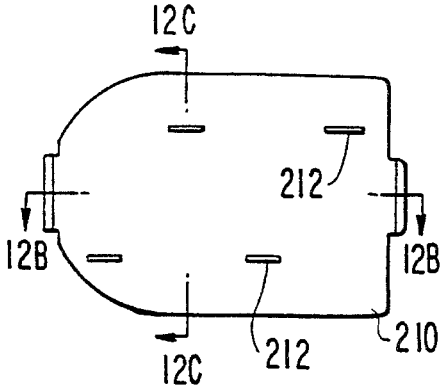
FIG. 12A is a top view of a four wire contact board which may be used in the system of the present invention.
Figure 12B:
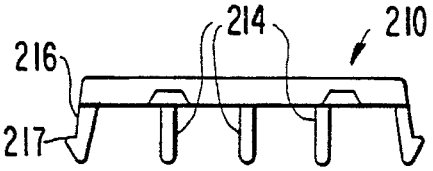
FIG. 12B is a longitudinal cross-sectional view of the four wire contact board shown in FIG. 12A.
Figure 12C:
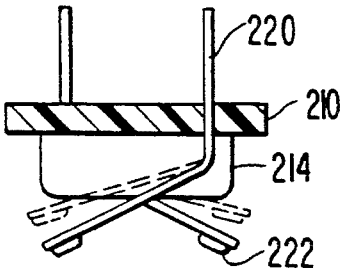
FIG. 12C is a lateral cross-sectional view of the contact board shown in FIG. 12A.

Contact board 210, which is preferably made of 20% glass filled polycarbonate (e.g., GE Lexan 500), is shown in detail in FIGS. 12A through 12C. In the top view of contact board 210 shown in FIG. 12A, four contact slits 212 are shown. Slip ring contacts 220 are molded in place in the positions shown in FIG. 12A. To ensure that the correct electrical connections are made during assembly, contact board 210 is preferably shaped in such a manner that it will fit into generally rectangular opening 73 only one way. As shown in FIG. 12A, contact board 210 may be generally rectangular in shape with rounded edges on one side (which match the rounded edges on one side of opening 73.)

In the longitudinal cross-sectional view of contact board 210 shown in FIG. 12B, locking arms 216 are shown at the ends of contact board 210. At the end of locking arms 216 are locking teeth 217, which lock contact board 210 firmly into generally rectangular opening 73 in handle body 70 by abutting the inside of handle body 70 at the edge of opening 73. Contact separators 214 also extend down from contact board 210. Contact separators ensure that slip ring contacts 220 do not inadvertently contact one another.

The cross-sectional view of FIG. 12C shows slip ring contacts 220 added to contact board 210. Slip ring contacts 220, which are preferably made of phosphor bronze, have silver tips 222 where they will contact slip rings 160. As shown in FIG. 12C, slip ring contacts 220 are designed to be deflected slightly when they are in contact with slip rings 160. The contact force between a slip ring 160 and its respective slip ring contact 220 will preferably be approximately 300–500 grams (i.e., approximately 300–500 gram-force units). FIG. 12C shows two slip ring contacts 220 in two adjacent positions on contact board 210. This will be the case if suction hose 10 includes four conducting wires. If only two conducting wires are embedded in suction hose 10, then contact board 210 will have only two slip ring contacts 220 at its opposite ends—to correspond to the first and fourth slip rings 160. In either case, as should be clear from the positioning of contact slits 212 shown in FIG. 12A, slip ring contacts 220 are preferably balanced on contact board 210, with an equal number of slip ring contacts 220 facing in each of the two possible directions. Adjacent slip ring contacts 220 also preferably face in opposite directions.

FIGS. 13A through 13C show spring terminals 230, which are preferably made of phosphor bronze alloy A510, in detail. FIG. 13A is a longitudinal cross-sectional view of spring terminal 230. Spring terminal 230 includes large crimping tabs 231 and small crimping tabs 232. Small crimping tabs 232 crimp the bare end of conducting wire to make electrical contact. Large crimping tabs 231 are crimped around the insulated wire to strengthen the connection between the wire and spring terminal 230. Crimping tabs 231 and 232 are attached to an upper flat 234. An angled portion of spring terminal 230 attaches upper flat 234 to lower flat 236. Contact leaf 238 extends upward from lower flat 236. Contact leaf 238 includes a detent slot 239, which is best shown in FIGS. 13B (which is a cross-sectional view of contact leaf 238) and 13C (which is a top view of contact leaf 238).

Figure 14:
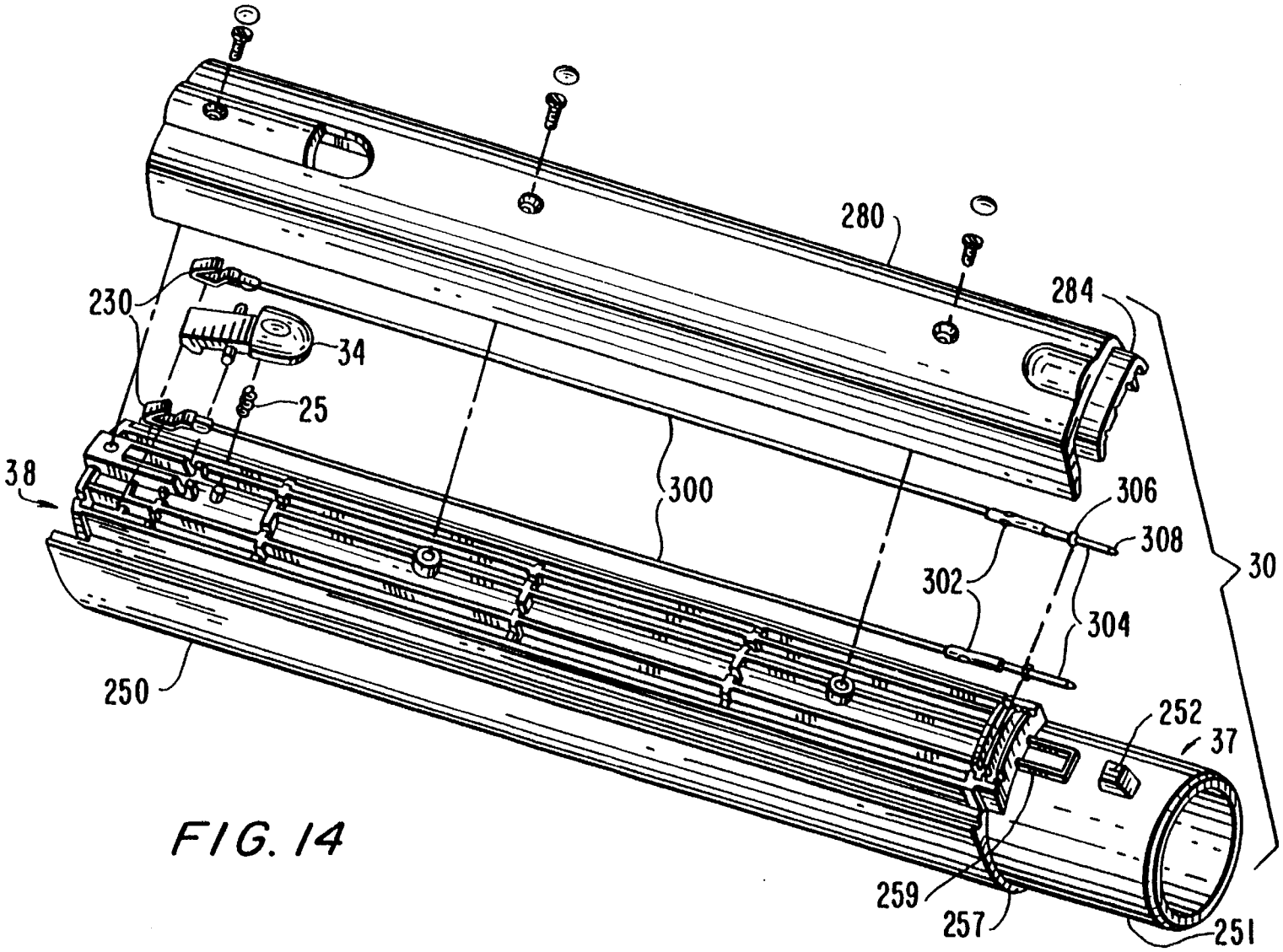
FIG. 14 is an exploded view of a wand which may be used in the system of the present invention.

An exploded view of wand 30 is shown in FIG. 14. Wand 30 includes wand body 250 and wand cover 280, which are preferably comprised of molded ABS plastic and are preferably held together by three screws, as shown in FIG. 14. As in handle 20, the screws are preferably self-tapping screws, the heads of which may then be covered with plastic caps colored to match the coloring of handle top 280. Wand 30, which has a male end 37 and a female end 38, includes a latch 34 which is identical to latch 24 in handle 20. Spring 25 is also identical to the spring 25 biasing the latch in handle 20.

Wand 30 will generally include two conducting wires 300 (which are preferably insulated wires), which wires 300 are shown in FIG. 14. Wires 300 are attached to spring terminals 230 at the female end 38 of wand 30. Spring terminals 230 are identical to the spring terminals 230 used in handle 20.

Figure 19:
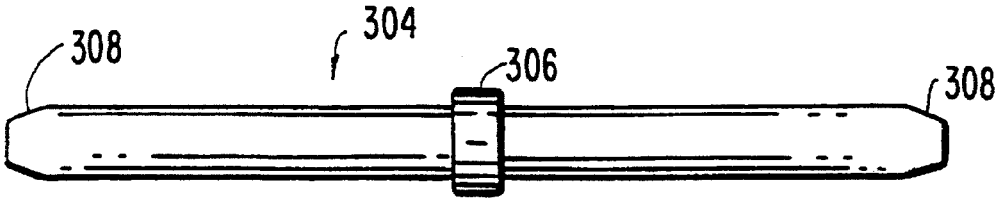
FIG. 19 is a side view of a pin terminal which may be used in the system of the present invention.

At the male end 37 of wand 30, each wire 300 is attached to a 0.093 barrel receptacle 302. Barrel receptacle 302 is preferably brass and of the type which can be obtained from Etco of Warwick, R.I. One end of a pin 304 is seated in each barrel receptacle 302. Pin 304, which is preferably an 0.093 sized pin made of solid brass, is shown in greater detail in FIG. 19. Pin 304 includes an alignment flange 306, and has two beveled ends 308.

Figure 15A:
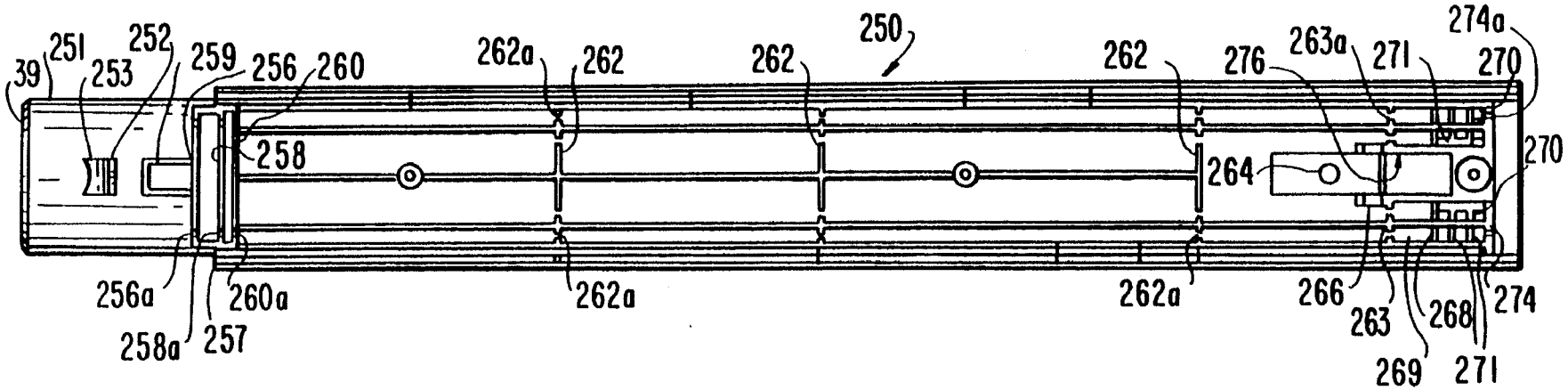
FIG. 15A is a top view of a wand body which may be used in the system of the present invention.
Figure 15B:
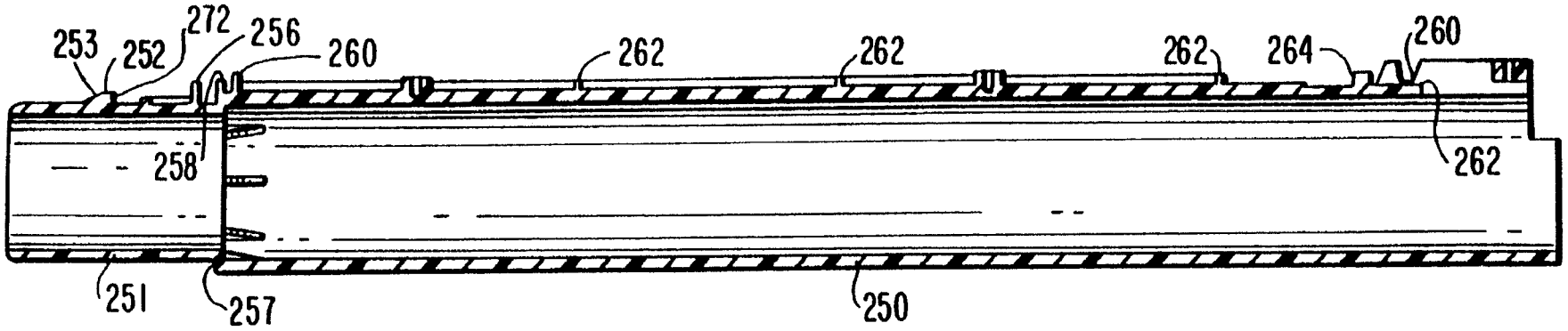
FIG. 15B is a longitudinal cross-sectional view of the wand body shown in FIG. 15A.

A top view of wand body 250 is shown in FIG. 15A, with a longitudinal cross-sectional view of wand body being shown in FIG. 15B. A locking projection 252 having a ramped surface 253 on one side is attached to a cylindrical flange 251 on the male end 37 of wand body 250. Two low walls 256 and 258 include two semicircular openings **256*a* and 258*a*, respectively. High wall 260 also includes two channel-shaped openings 260*a*. Each pin 304 is placed in one of the two aligned sets of openings 256*a*, 258*a* and 260*a*, such that alignment flange 306 is located between high wall 260 and low wall 258. The gap between high wall 260 and low wall 258 is preferably such that alignment flange 306 fits snugly therein. Angled key 259 extends from low wall 256 towards locking projection 252**, narrowing slightly as it extends forward.

Like handle body 70, wand body 250 includes a number of wire guides 262, with gaps **262*a* therein. Each of gaps 262*a*** spans a distance which is slightly less than the total diameter of any one of the two insulated wires which may be employed.

Like handle body 70, wand body 250 also includes a boss 264 for spring 25 and pivot supports 266 for latch 34. When latch 34 is in place, locking arm 322 extends into slot opening 276, which is located between pivot supports 266 and the female end 38 of wand body 250. Near pivot supports 266 is another wire guide 263, with gaps **263*a* therein. Wire guide 263 forms the rearmost wall of rear pockets 269. Flat topped walls 268 separate rear pockets 269** from front pockets 270. Front pockets 270 include leveling supports 271. Front wall 274 forms the front wall of front pockets 270. Front wall 274 includes two semicircular openings 274*a* which, together with similar semicircular openings 294*a* formed in protruding wall 294 of wand cover 280, form circular openings into front pockets 270 to permit one end of pins 304 to enter front pockets 270 and slide into detent slot 239 in the contact leaf 238 of spring terminal 230, as will be described below.

Figure 16:
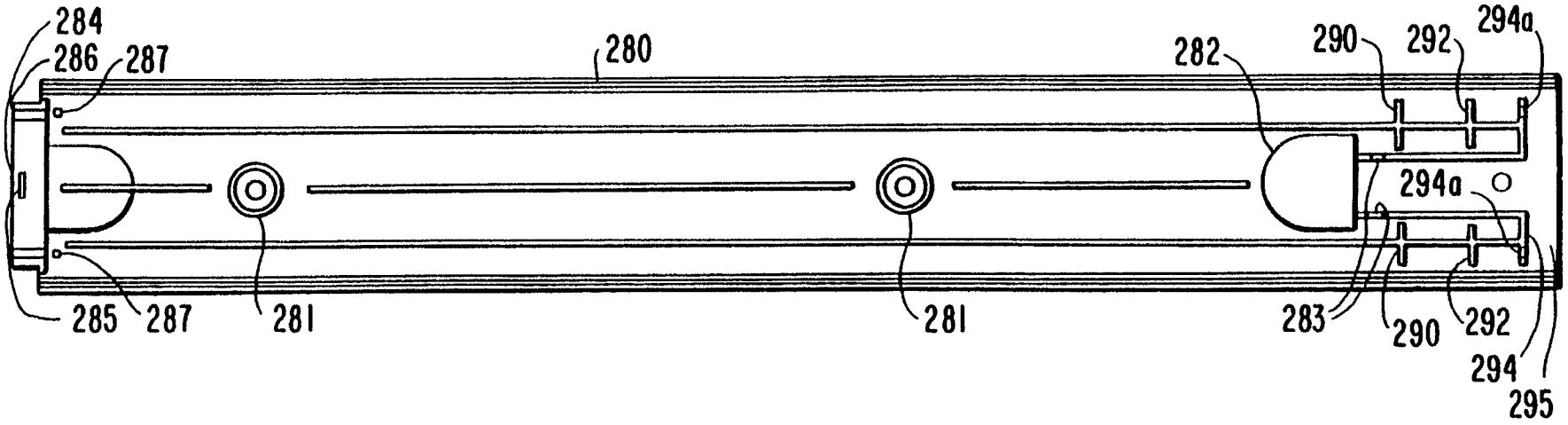
FIG. 16 is a bottom view of the inside of a wand cover which may be used in the system of the present invention.

The inside of wand cover 280 is shown in the bottom view of FIG. 16. The male end of wand cover 280 includes an arced flange 284 (which can also be seen in FIG. 14). Arced flange 284 includes a stop wall 285 and two semi-cylindrical channels 286. Two square posts 287 extend down from wand cover 280.

At the opposite end of wand cover 280 there is a latch opening 282, through which latch button 326 protrudes. Directly in front of latch opening 282 are two ribs which include rectangular projections 283. Low walls 290 extend down from the top of wand cover 280. When wand cover 280 is joined to wand body 250, the bottoms of low walls 290 abut the top of raised wire guide 263 to hold wires into the gaps 263*a* in wire guide 263. Prongs 292 also extend down from the top of wand cover 280, such that when wand cover 280 is joined to the wand body 250, the bottoms of prongs 292 rest in front pockets 270, holding spring terminals 230 into position. Two centering bosses 281 surround the screw holes shown in FIG. 16 to help center wand cover 280 on wand body 250.

Wand cover 280 also includes forward walls 294, each of which includes a semicircular opening 294*a*. Forward walls 294 are spaced a short distance from the end of wand cover 280 to form an extension 295, which extends from forward walls 295 to the end of wand cover 280. When wand cover 280 is joined to the wand body 250 as described below, the semicircular openings 294*a* extend down from wand cover 280 to abut semicircular openings 274*a* in the front of wand body 250 to form circular openings to permit pins 304 to contact spring terminals 230. Rectangular projections 283 fit into the open end of pivot supports 80 to lock latch 24 in place.

After the wires 300, barrel receptacles 302, pins 304, spring terminals 230, latch 24 and spring 25 shown in FIG. 14 have been put in place on wand body 250 as shown and described, wand cover 280 is placed on wand body 250 as shown in FIG. 14. Arced flange 284 fits over low walls 256 and 258, with stop wall 285 abutting low wall 256. Openings 256*a* and 258*a* line up with semi-cylindrical channels 286. Square posts 287 fit into channel-shaped openings 260*a* in high wall 260 to hold wires 300 in place. Stop wall 285 abuts the inside of low wall 256 to properly position wand cover 280 with respect to wand body 250.

FIG. 17B shows an end view of the male end 37 of wand 30. As shown in FIG. 17B, pins 304 are held in the openings formed by semicircular openings 256*a* in low wall 256 and the semi-cylindrical channels 286 formed in arced flange 284. On each side, wand body 250 includes a groove 255 which preferably runs along the entire length of wand body 250. Groove 255 is formed by flange 254. Each side of wand cover 280 includes a projecting edge 288 which preferably runs the entire length of wand cover 280. Adjacent to projecting edge 288 is a flat 289. As shown in FIG. 17B, projecting edge 288 slides into groove 255 and the top of flange 254 abuts flat 289 when wand body 250 and wand cover 280 are joined. The ramped surface 253 on locking projection 252 is shown at the top of cylindrical flange 251, which surrounds the suction conduit. A portion of angled key 259, which is preferably slightly wider than locking projection 252 where angled key meets low wall 256, can be seen in FIG. 17B sticking out from behind the sides of locking projection 252. Rim 257 surrounds the lower portion of cylindrical flange 251.

FIG. 17C shows an end view of the female end 38 of wand 30. The openings for pins 304 are formed from semicircular openings 274*a* in front wall 274 of wand body 250 and semicircular openings 294*a* in protruding walls 294 of wand cover 280. Extension 295 on wand cover 280 extends outward from wand cover 280 past protruding walls 294. The lower portion of the suction conduit is surrounded by lower suction conduit wall 277. The edge of lower suction conduit wall 277 is even with the edge of extension 295.

Figures 18A, 18B:
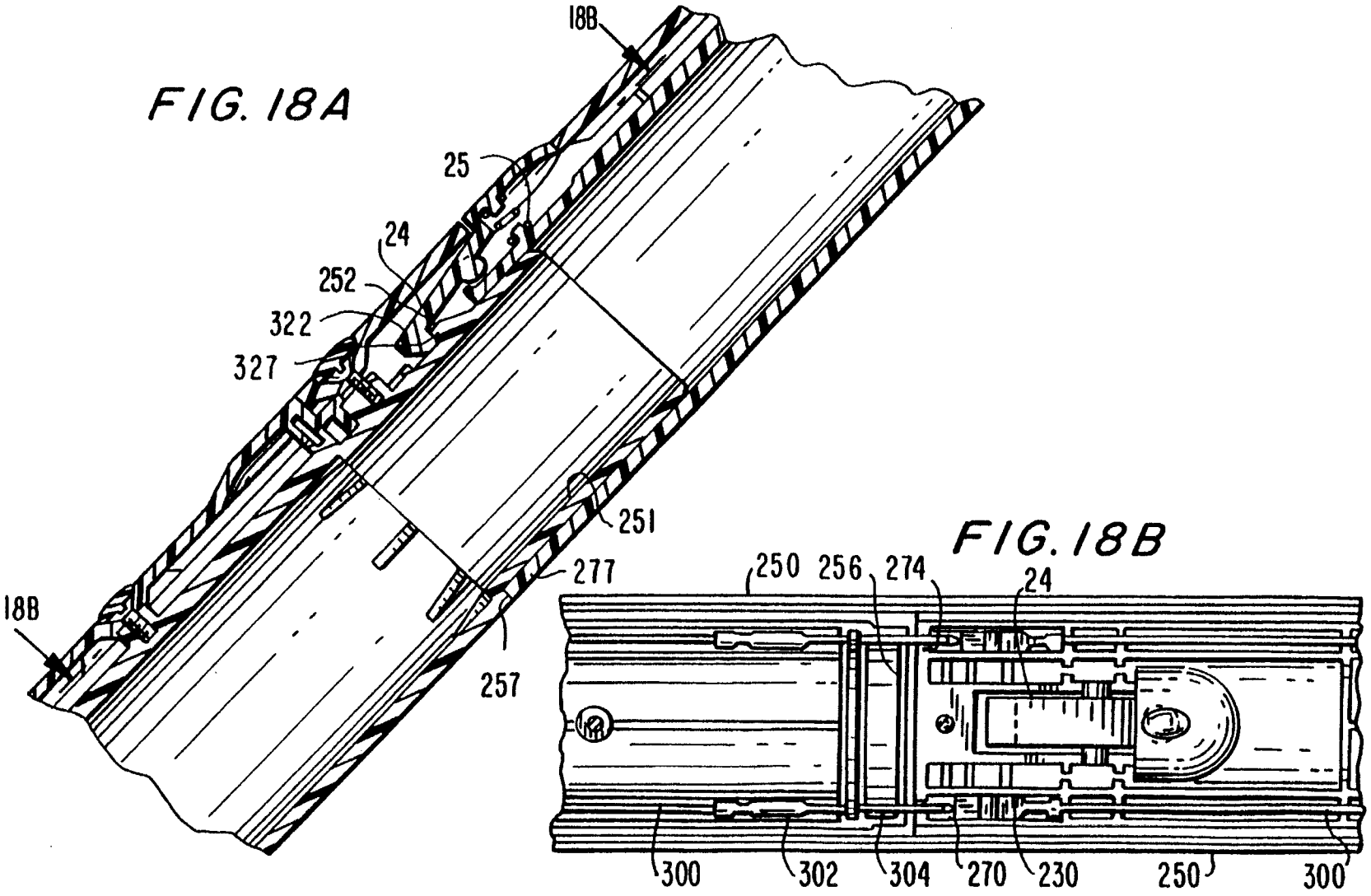
FIG. 18A is a longitudinal cross-sectional view of the interface between two joined wands which may be used in the system of the present invention.
FIG. 18B is a top view of the two joined wands shown in FIG. 18A with their wand covers removed.

Front rib 273 bridges keyway walls 275 to form a keyway. The ramped front side 327 of locking arm 322 of latch 24 is shown in the keyway. When two wand sections are joined, locking projection 252 and angled key 259 on the male end 37 of one wand 30 slide into the keyway until the ramped front side 327 of locking arm 322 abuts the ramped surface 253 on locking projection 252. By continuing to urge the two wand sections together, the ramped front side 327 of locking arm 322 is urged upward by ramped surface 253, compressing spring 25. When locking projection 252 has been urged just beyond steep back wall 328 of locking arm 322, the tension in spring 25 will pivot locking arm 322 of latch 24 downward such that steep back wall 328 of locking arm 322 is in contact with the back wall 272 of locking projection 252. This is shown in the cross-sectional view of FIG. 18A, which is taken along the line shown in FIG. 1. As shown in FIG. 18A, the male end 37 of wand body 250 fits into the female end 38 of the wand body 250 of another wand section 30. Latch 24 and locking projection 252 prevent wands 30 from moving apart. The portion of angled key 259 nearest low wall 256 fits snugly in the keyway formed by keyway walls 275 to prevent one wand 30 from rotating axially with respect to the other wand 30. Pins 304 will extend through the openings formed by semicircular openings 274*a* and 294*a* and into front pockets 270, where pins 304 will contact spring terminals 230 by resting in the detent slots 239 formed in contact leaves 238.

As shown in FIG. 18A, rim 257 abuts the edge of lower suction conduit wall 277, while the front and rear edges of wand cover 280 of the respective wands 30 abut to prevent wands 30 from moving toward one another once they are locked into position. Thus latch 24 locks wands 30 firmly together until latch button 326 is depressed to raise locking arm 322 and permit locking projection 252 to be moved along the keyway past the locking tooth 325 of latch 24, and thus permit wands 30 to be separated.

FIG. 18B is a top view of two joined wand body sections 250 with the wand covers 280 removed. As described above, each of pins 304 extends through an opening 274*a* in front wall 274 and into a front pocket 270, where it contacts the detent slot 239 on the contact leaf 238 of a spring terminal 230.

It will be noted that the front end of handle 20, an end view of which is shown in FIG. 11, is identical to the female end 38 of wand 30 (shown in FIG. 17C) with respect to the locking mechanism and configuration described in the previous three paragraphs. Thus the male end 37 of a wand 30 can be locked onto handle 30 in the same manner described above that male end 37 of wand 30 can be locked onto the female end 38 of another wand 30.

In addition to another wand 30, the female end 38 of wand 30 may also be attached to elbow 40. Elbow 40 is preferably used for joining a wand 30 to a powered floor nozzle 50, as shown in FIG. 1. As will be described in detail below, elbow 40 is preferably mounted to powered floor nozzle 50 in a permanent manner, i.e., mounted to powered floor nozzle 50 in such a manner that the user of the vacuum cleaner system will not ordinarily remove elbow 40 from powered floor nozzle 50. By contrast, wand 30 attaches to elbow using the same latch mechanism described in detail above. Thus the user of the vacuum cleaner system will easily be able to attach and detach powered floor nozzle 50 and a wand 30 via elbow 40. The user of the vacuum cleaner system will also be able to easily attach other powered or unpowered cleaning tools to wand 30, as will be described in detail below.

Figure 21:
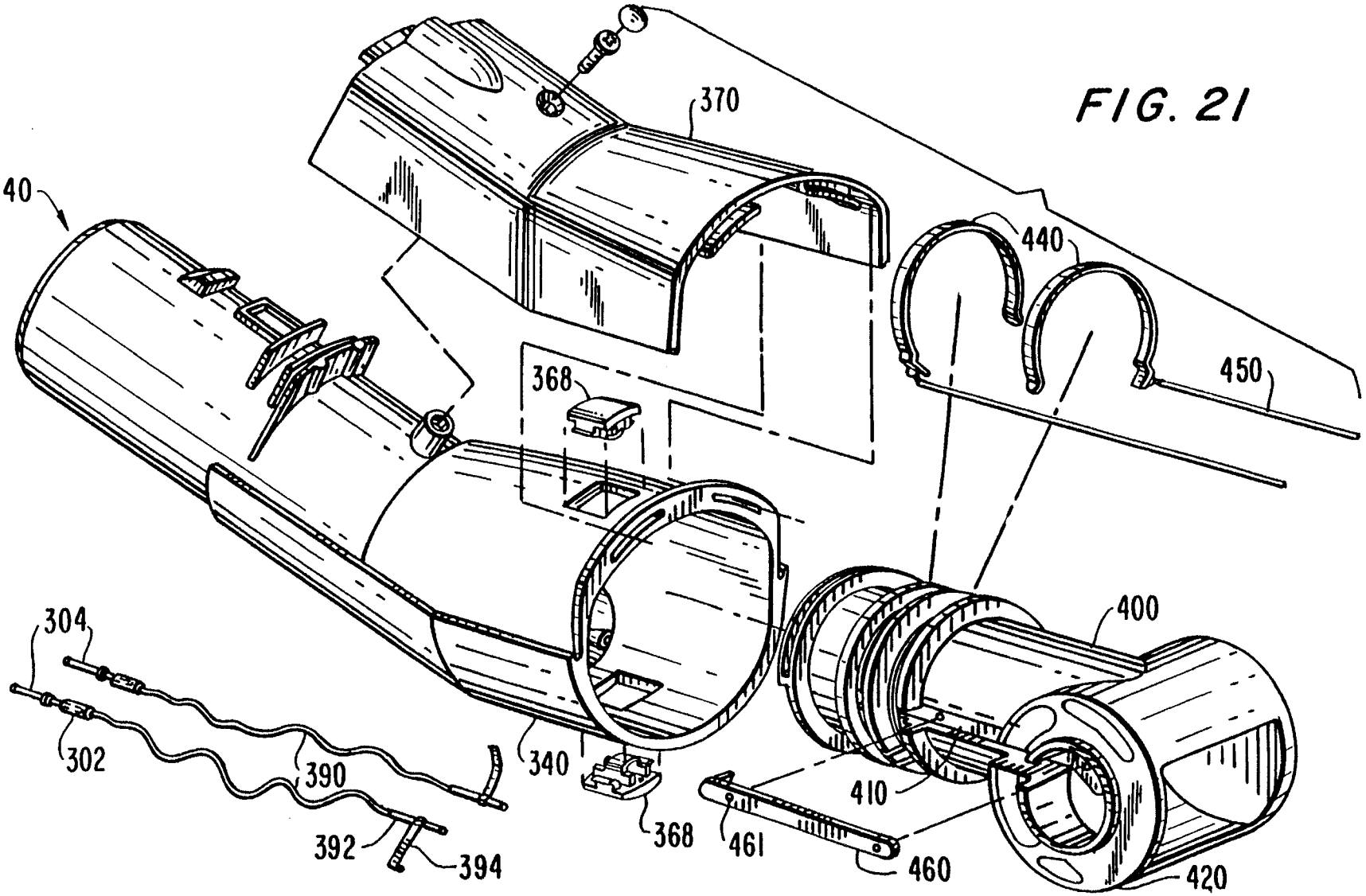
FIG. 21 is an exploded view of a swivel elbow which may be used in the system of the present invention.

An exploded view of elbow 40 is shown in FIG. 21. Elbow 40 comprises a swivel body 340 and swivel cover 370. Two conducting wires 390 are enclosed between swivel body 340 and swivel cover 370. Each wire 390 is attached to a barrel receptacle 302 in which a pin 304 is seated. Pins 304 are mounted to swivel body in a manner very similar to the pins 304 mounted to wand body 250, as will be discussed in detail below. The other ends of wires 390 are attached to one-ended pins 392. One-ended pins 392 are inserted into loops in swivel contacts 394. One-ended pins 392 are mounted to swivel body 340 so as to enable swivel contacts 394 to make electrical contact with snap ring contacts 440, which are mounted on swivel elbow 400. Pawls 368 seat in openings in the top and bottom of Swivel body 340. Swivel cover 370 is preferably joined to swivel body 340 by means of a screw, which may be covered with a plastic cap as shown in FIG. 21.

Wires 450, which are attached to snap ring contacts 440 by means of an electrical connector, run along channel 410 to the pivot end 420 of swivel elbow 400. Wire cover 460 covers channel 410 so that wires 450 are not visible.

Figure 22A:
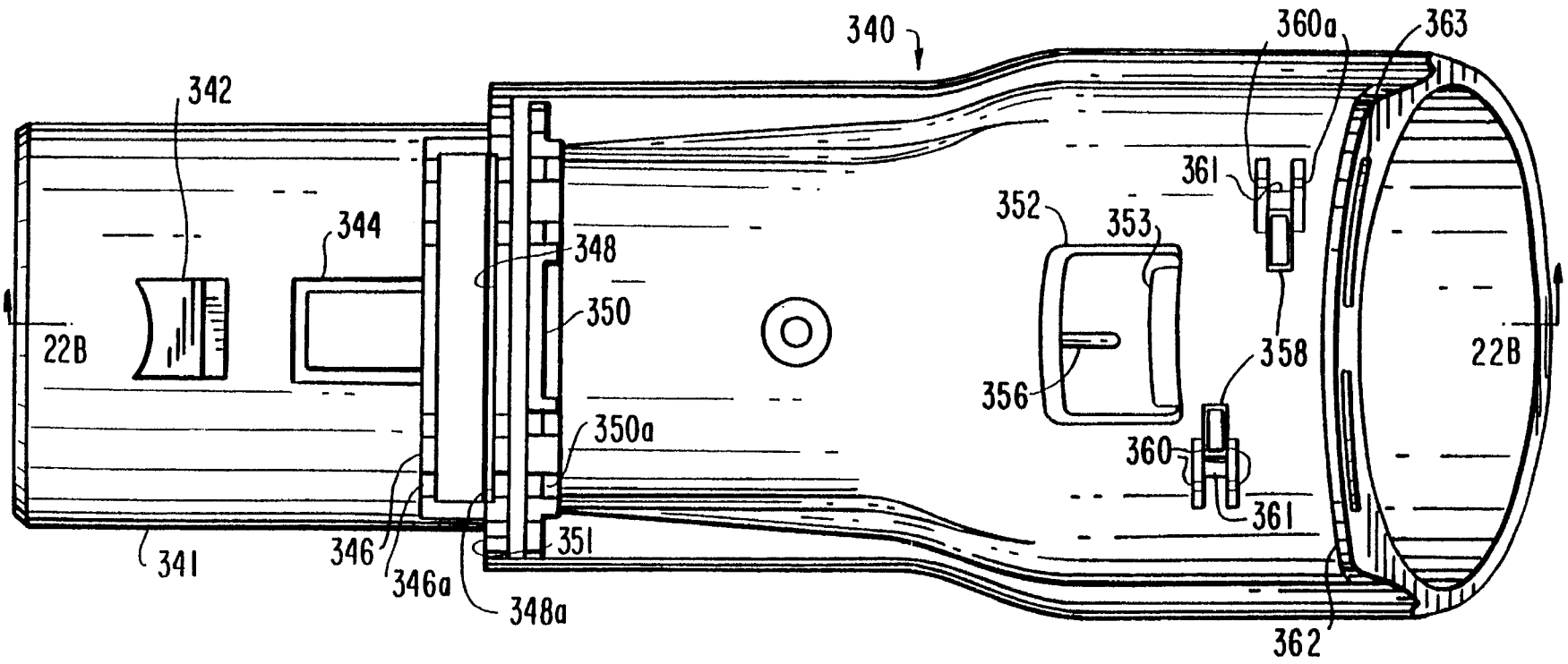
FIG. 22A is a top view of a swivel body which may be employed in the present invention.

FIG. 22A is a detailed view of the top of swivel body 340. As noted above, elbow 40 can be attached to the female end 38 of a wand section 30. Consequently, the end of swivel body 340 which attaches to wand 30 is virtually identical to the male end 37 of wand body 250. Like wand body 250, swivel body 340 includes a cylindrical flange 341, a locking projection 342, an angled key 344, low walls 346 and 348, and a high wall 350. Low walls 346 and 358 also have the same semicircular openings 346*a* and 348*a* as their counterparts on wand body 250, while high wall 250 has the same channel-shaped openings 350*a* as did its counterpart on wand body 250. Consequently, pins 304 fit into openings 246*a*, 348*a* and 350*a* in the same manner described in connection with wand body 250. Swivel body 340 also has a rim 351, similar to rim 257 on wand body 250.

Figure 22B:
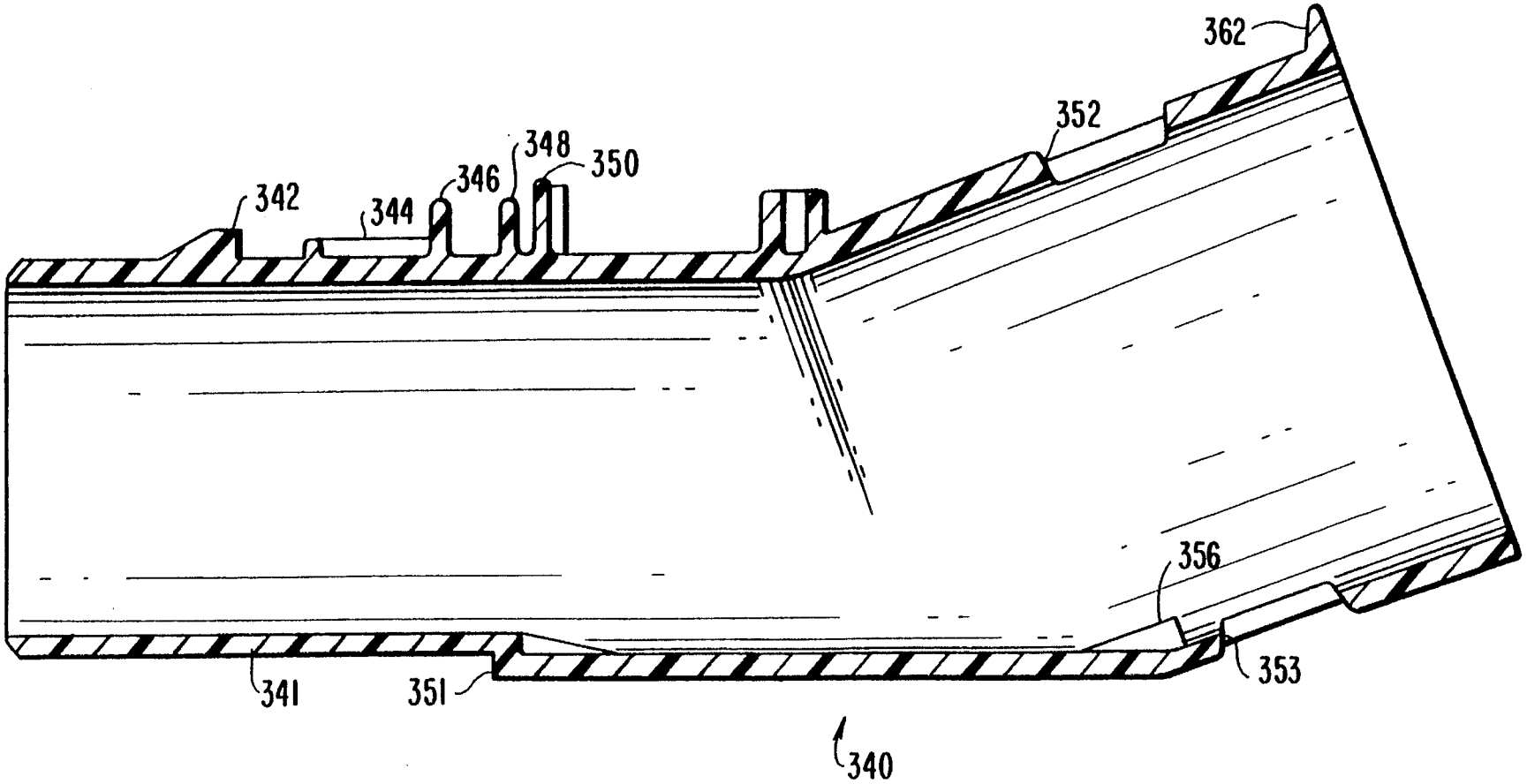
FIG. 22B is a cross-sectional view of the swivel body shown in FIG.22A.
Figure 22C:
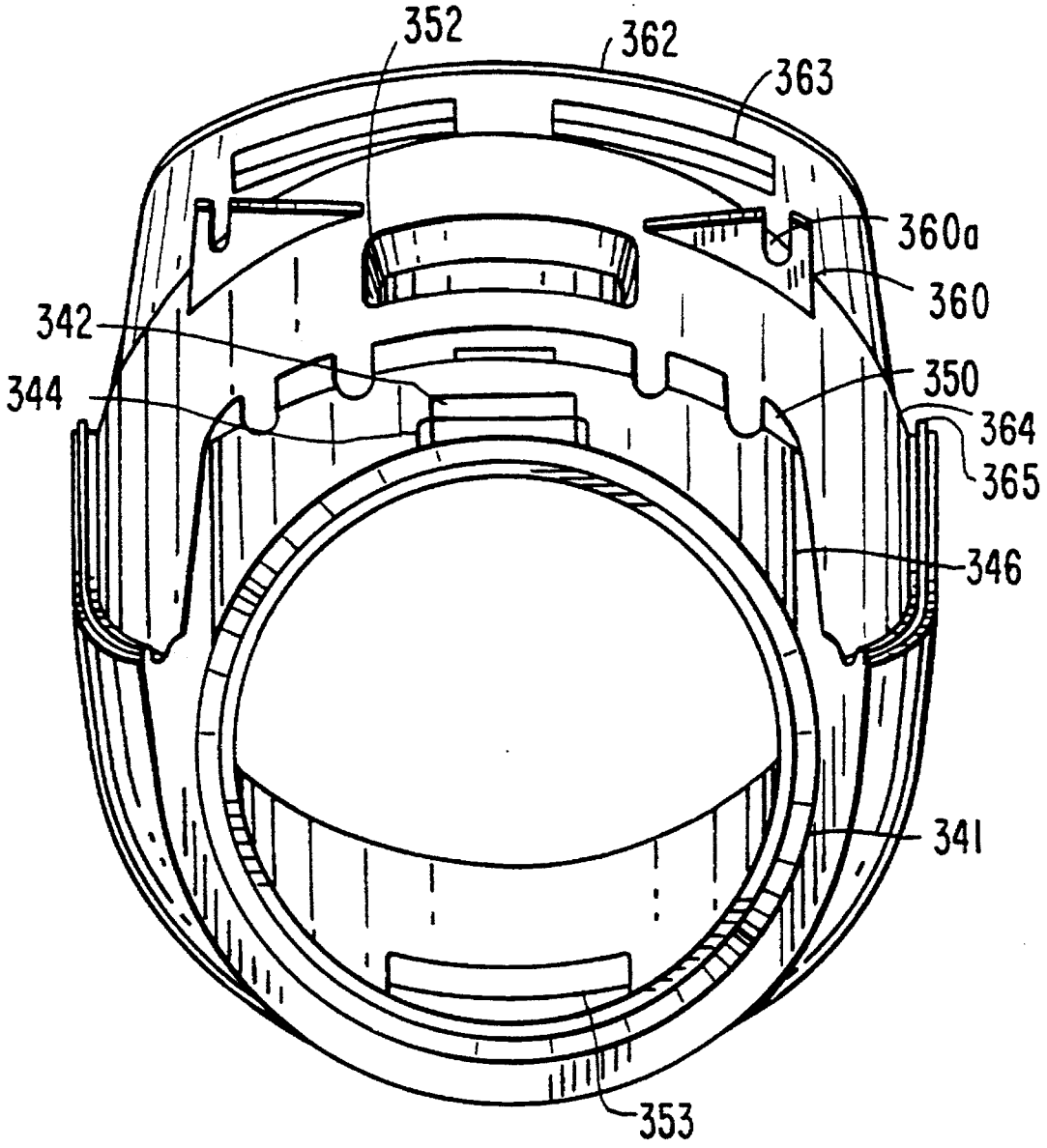
FIG. 22C is a front view of the swivel body shown in FIG. 22A.

Swivel body 340 includes two pawl openings 352 and 353 on opposite sides of swivel body. (Pawl openings 352 and 353 are best shown in the longitudinal cross-sectional view of swivel body 340 shown in FIG. 22B, taken along the lines shown in FIG. 22A.) Stop wall 356 is shown on the inside of swivel body 340, being visible through pawl opening 352. There are two contact openings 358 in front of pawl opening 352. Adjacent each contact opening 358 is a pair of angled support walls 360. Angled support walls 360, which are angled slightly forward, are best shown in the rear end view of swivel body 340 (i.e., the view from the end which resembles the male end 37 of wand body 250) shown in FIG. 22C. Each angled support wall 360 has a channel-shaped opening 360*a* which is sized to tightly hold one-ended pin 392 firmly in place. Angled flats 361 extend from the inner sides of channel-shaped opening 360*a* down to the outer ends of contact openings 358.

The front end of swivel body 340 includes a ridge 362 with two arced openings 363 therein. Like wand body 250, swivel body 340 also has a groove 364 running along each of its sides. Grooves 364 are formed by flange 365, which also runs along each side of swivel body 340.

Figure 23A:
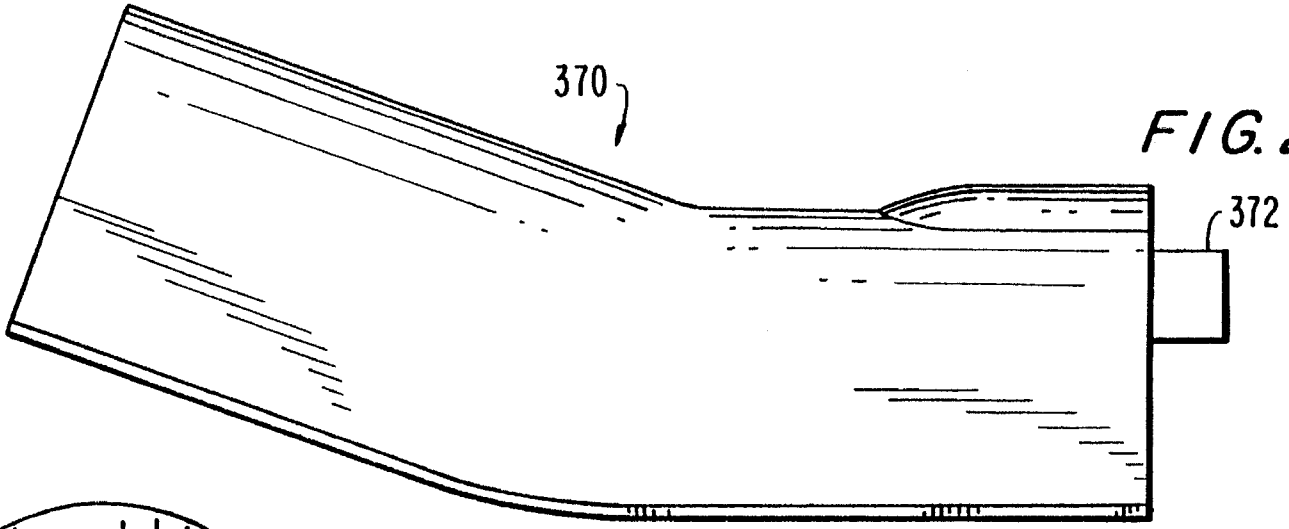
FIG. 23A is a side view of a swivel cover which may be used in the system of the present invention.
Figure 23D:
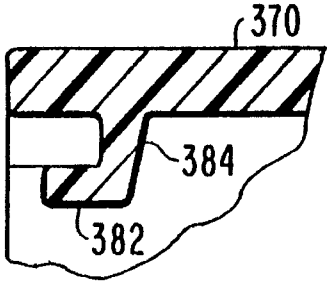
FIG. 23D is a cross-sectional view of a portion of the swivel cover shown in FIG. 23A, viewed along the line shown in FIG. 23C.

Swivel cover 370 is shown in detail in FIGS. 23A through 23D. FIG. 23A shows arced flange 372 which is virtually identical to arced flange 284 on wand cover 280. As shown in the bottom view of the inside of swivel cover 370 shown in FIG. 23B, arced flange 372 includes a stop wall 374 and two semi-cylindrical channels 376. As with wand cover 280, square posts 378 extend down from the top of swivel cover 370.

Swivel cover 370 also includes contact retaining walls 380 which fit between angled support walls 360 on swivel body 340 to hold swivel contacts 394 in place when swivel cover 370 is joined to swivel body 340 and to preload swivel contacts 394 against snap ring contacts 440.

Swivel cover 370 also includes arced tabs 382 which extend forward from tab supports 384. Arced tabs 382 are best shown in the front view of swivel cover 370 shown in FIG. 23C and in the cross-sectional view 23D, taken along the line shown in FIG. 23C. When swivel cover 370 is joined to swivel body 340, arced tabs 382 fit into arced openings 363 on swivel body 340.

Figure 23C:
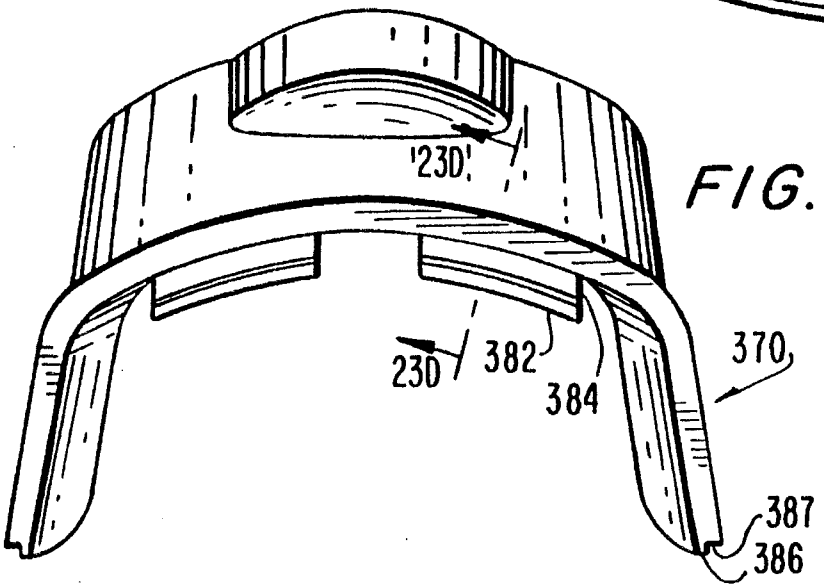
FIG. 23C is a front view of the swivel cover shown in FIG. 23A.
Figure 23B:
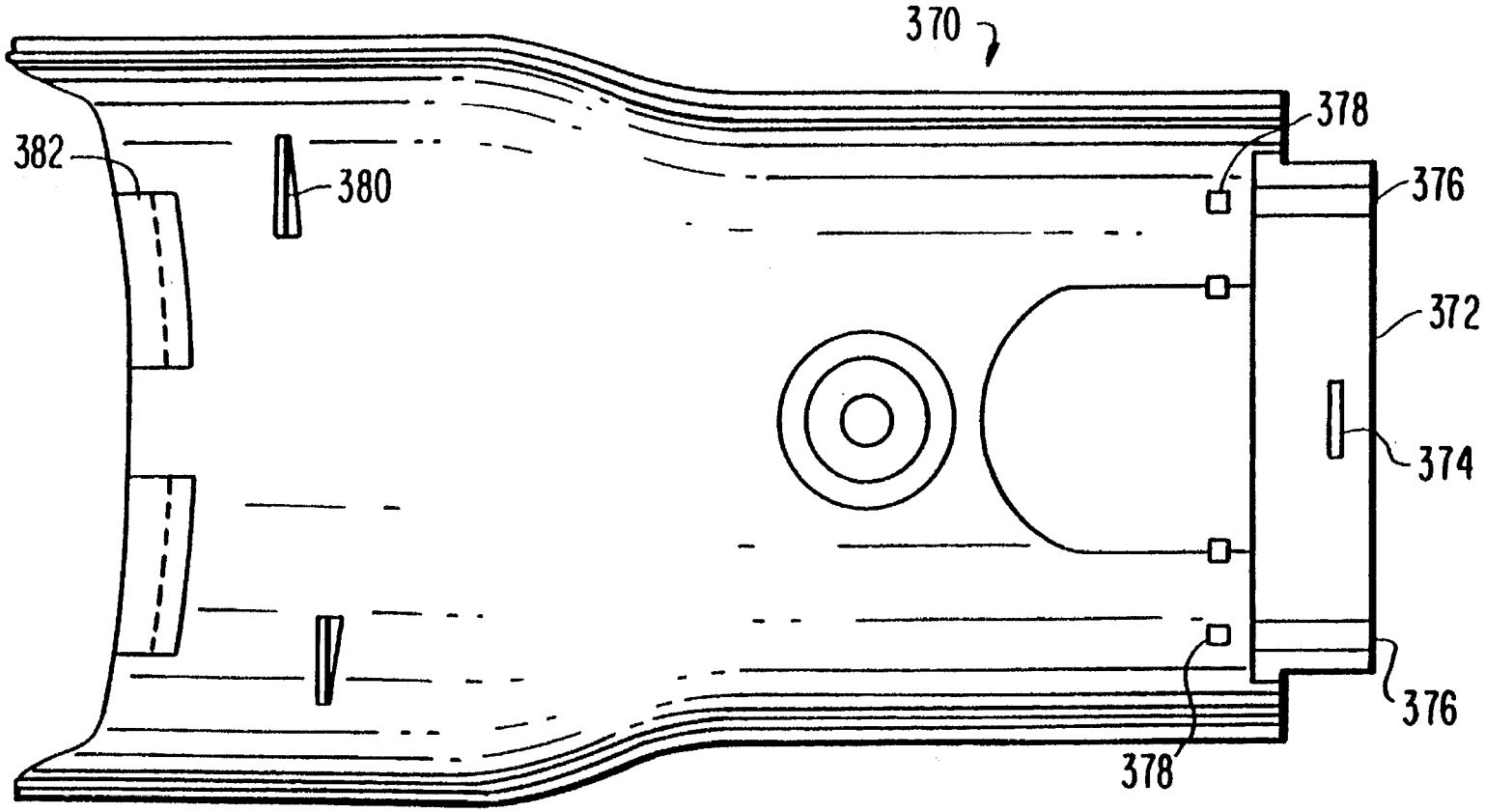
FIG. 23B is a bottom view of the inside of the swivel cover shown in FIG. 23A.

Like wand cover 280, swivel cover 370 includes projecting edges 386 and flats 387 along its two sides, as is best shown in FIG. 23C.

Swivel elbow 400, which is preferably made of ABS plastic, is shown in detail in FIGS. 24A through 24E. As shown in the side view of FIG. 24A, swivel elbow 400 comprises suction tube 401 and cylindrical pivot 420. Suction tube 401 is a cylindrical tube surrounding suction passageway 426 (shown in outline form in the side view shown in FIG. 24B—which depicts the opposite side of swivel elbow 400 from that shown in FIG. 24A). Spacing rings 402 and 403 encircle suction tube 401. Top spacing ring 404 includes an offset portion 405, which is offset upward slightly to create two stop walls 406 (one on each side of swivel elbow 400). Offset portion 405 preferably comprises slightly less than 180 degrees of the spacing ring, as is best shown in the top view of swivel elbow 400 in FIG. 24F.

Figure 24A:
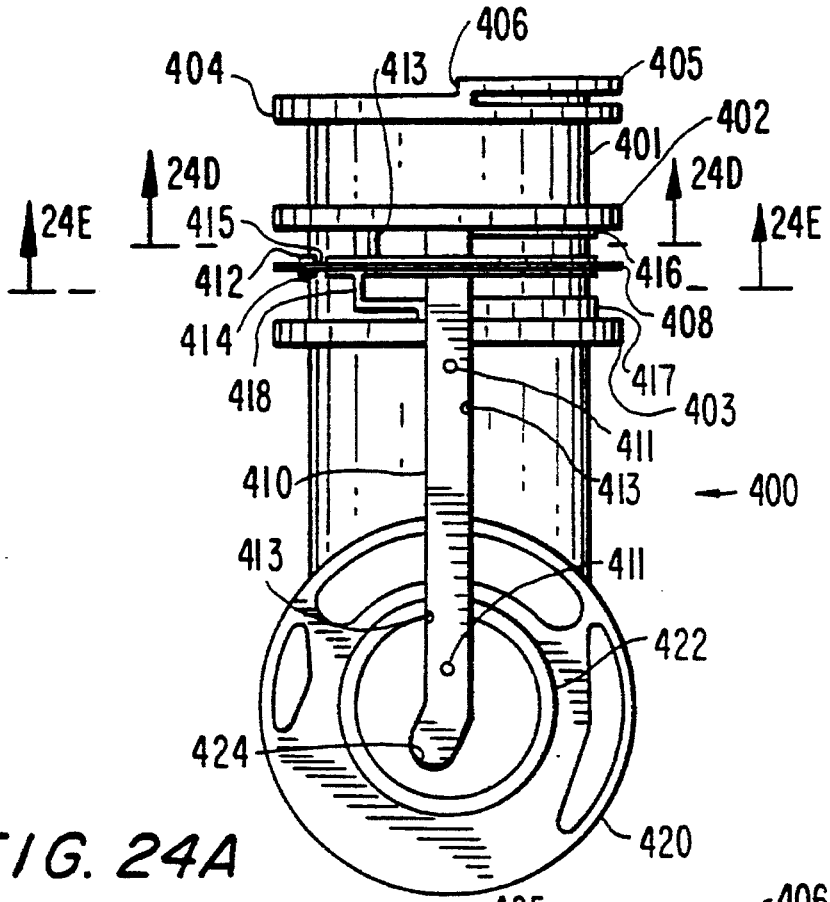
FIG. 24A is a side view of a swivel elbow which may be employed in the present invention.

Between spacing rings 402 and 403 is a separation wall 408, which separates snap ring contacts 440 from one another when they are placed on swivel elbow 400, as will be described below. A wire channel 410 extends from spacing ring 402 down past the center of cylindrical pivot 420. Two posts 411 extend up from the bottom of wire channel 410 as shown in FIG. 24A (the upper post 411 can also be seen in the back view of FIG. 24C). As shown in FIG. 21, wire cover 460 includes two holes 461 into which posts 411 fit tightly, to hold wire cover 460 in place. Two spacers 413 extending from the sides of wire channel 410 prevent wire cover 460 from sliding down posts 411 to the bottom of channel 410 to insure that wires 450 from snap ring contacts 440 are not crushed by wire cover 460.

Figure 24B:
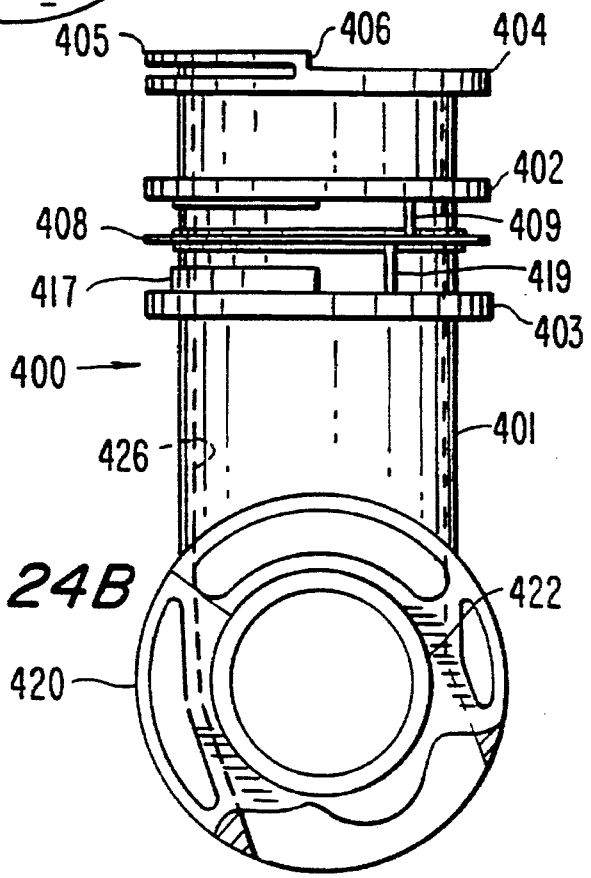
FIG. 24B is a side view of the opposite side of the swivel elbow shown in FIG. 24A.
Figure 24D:
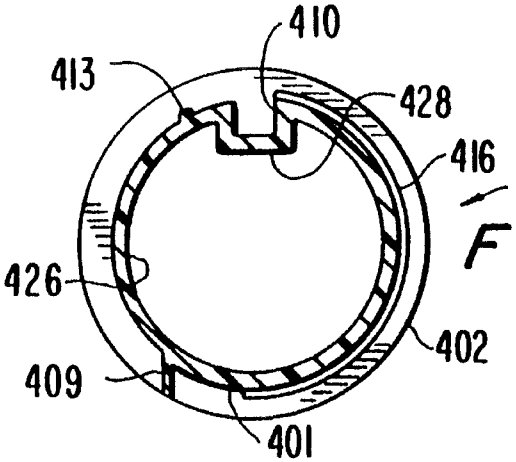
FIG. 24D is cross-sectional view of the swivel elbow shown in FIG. 24A.
Figure 24E:
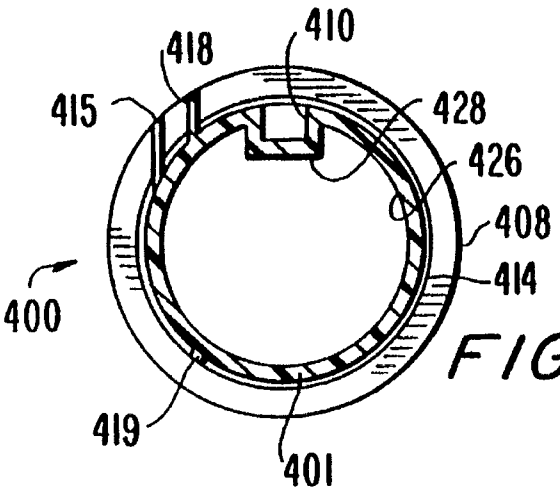
FIG. 24E is another cross-sectional view of the swivel elbow shown in FIG. 24A.
Figure 24C:
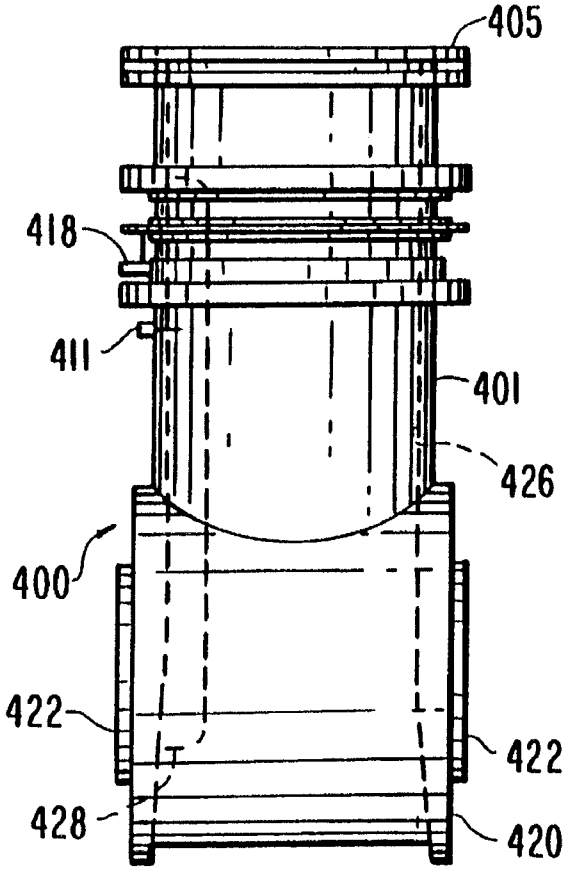
FIG. 24C is a front view of the swivel elbow shown in FIG. 24A.
Figure 24F:
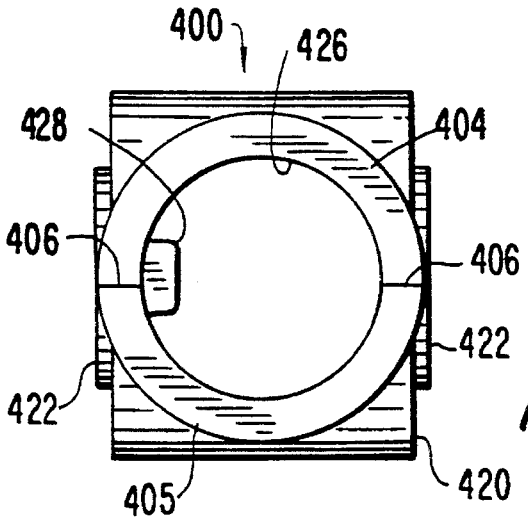
FIG. 24F is a top view of the swivel elbow shown in FIG. 24A.

Wire channel 410 creates an indentation 428 in suction conduit 426 (indentation 428 and suction conduit 426 are shown in FIG. 24F, as well as being shown in outline form in FIG. 24C).

Separation wall 408 is surrounded by two snap ring spacers 412 and 414. Separation wall 408 and snap ring spacers 412 and 414 entirely encircle suction tube 401, except for angled gap 415, which is shown in FIG. 24A and in the cross-sectional view shown in FIG. 24E, which is taken along the line shown in FIG. 24A. Between separation ring 408 and spacing ring 403 is L-shaped wall 418, which is shown in FIG. 24A and, in part, in FIG. 24E. Also between separation ring 408 and spacing ring 403 is ridge 419, which is shown in FIGS. 24B and 24E. Wide snap ring spacer 417, which is adjacent to spacing ring 403, extends approximately half of the way around suction tube 401. As will be discussed below lower snap ring contact 440 is held in place on suction tube 401 by ridge 419, L-shaped wall 418, snap ring spacer 414 and wide snap ring spacer 417.

The region on suction tube 401 between separation ring 408 and spacing ring 402 includes similar structure to hold upper snap ring contact 440 in place. In addition to snap ring spacer 412, another snap ring spacer 416 (which is best shown in the cross-sectional view of FIG. 24D, which is taken on the line shown in FIG. 24A) which is adjacent to upper spacing ring 402 extends approximately half way around suction tube 401. Ridge 413 extends from separation ring 408 to spacing ring 402, as shown in FIGS. 24A and 24D. Wall 409, which is shown in FIGS. 24B and 24D, also extends from separation ring 408 to spacing ring 402.

Figure 24G:
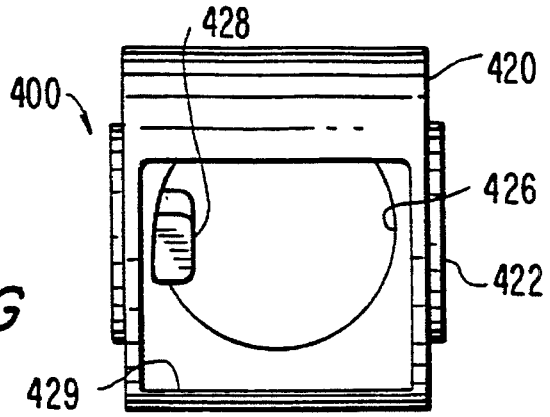
FIG. 24G is a bottom view of the swivel elbow shown in FIG. 24A.

Cylindrical pivot 420 includes two circular rims 422. The circular rim 422 shown in FIG. 24A is broken by wire channel 410. FIG. 24G shows a bottom view of swivel elbow 400. As can be seen in FIG. 24G, a generally square opening 429 forms the bottom end of suction conduit 426, as opposed to the circular opening at the top of swivel elbow 400, which is shown in FIG. 24F.

Figure 25:
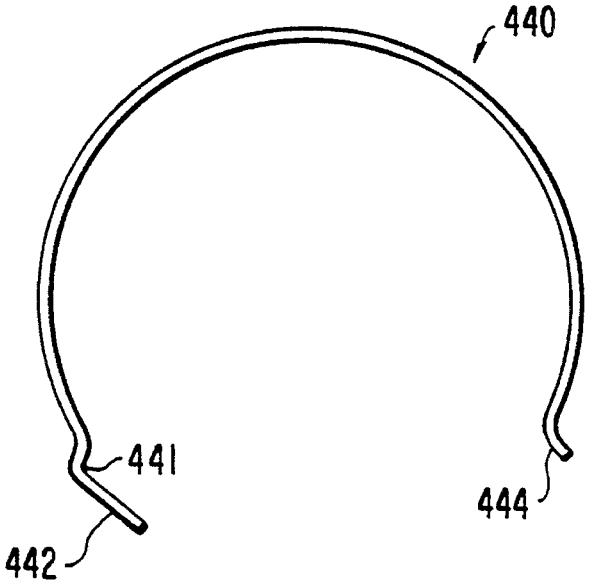
FIG. 25 is a side view of a snap ring contact which may be employed in the system of the present invention.

A snap ring contact 440 is shown in detail in FIG. 25. Snap ring contact 440, which is preferably about 0.110 inches wide and is preferably made of phosphor bronze, includes a straight end 442 with a bend 441 and a curved end 444. A conventional electrical connector, such as part number 3650H3AB-2 available from Arkless Corporation of Stoughton, Mass. attaches wire 450 to the straight end 442 of snap ring contact 440. Once wires 450 are connected to snap ring contacts 440, snap ring contacts 440 can be snapped onto suction tube 401 of swivel elbow 400. The lower snap ring contact 440 is snapped onto suction tube 401 between snap ring spacer 414 and wide snap ring spacer 417, such that curved end 444 abuts the upper end of L-shaped wall 418, and such that bend 441 abuts ridge 419, with straight end 442 extending past ridge 419 toward wire channel 410. Wire 450 attached to lower snap ring contact 440 then passes through the gap between L-shaped wall 418 and spacing ring 403 into wire channel 410.

The upper snap ring contact 440 is snapped onto suction tube 401 between snap ring spacer 412 and snap ring spacer 416, such that curved end 444 abuts wall 409, and such that bend 441 abuts ridge 413, with straight end 442 extending past ridge 419 away from wire channel 410. Wire 450 attached to upper snap ring contact 440 then passes through the gap 415 in separation wall 408 and back between L-shaped wall 418 and spacing ring 403 into wire channel 410. Wires 450 then extend from the top of wire channel 410 to the bottom of wire channel 410, with wires 450 exiting wire channel 410 at curved end 424. Wire cover 460 is then placed over wires 450 in wire channel 410, with posts 411 passing through the holes 461 in wire cover 460. As will be discussed below, wires 450 extending from the bottom of wire channel 410 are attached via conventional means (i.e., suitable connectors or a socket) to a motor (for powering a beater brush) and/or a light bulb in powered floor nozzle 50.

Once snap ring contacts 440 and wires 450 are in place as described above, swivel elbow 400 may be inserted into swivel body 340 as shown in FIG. 21. Swivel elbow 400 slides into swivel body 340 until spacing ring 404 abuts stop wall 356 on the inside of swivel body 340. Spacing rings 402, 403 and 404 are sized so as to fit snugly inside the bottom end of swivel body 340 (so as to provide a sufficient seal for the suction conduit), while still permitting swivel elbow 400 to rotate axially within swivel body 340. Swivel elbow 400 will rotate within swivel body until one of the two stop walls 406 on swivel elbow 400 abuts stop wall 356 in swivel body 340. Thus swivel elbow 400 will rotate approximately 90 degrees in each direction from the position shown in FIG. 21 (once swivel elbow 400 is inserted into swivel body 340) until stop wall 356 hits either of stop walls 406, preventing further rotation.

Figure 26A:
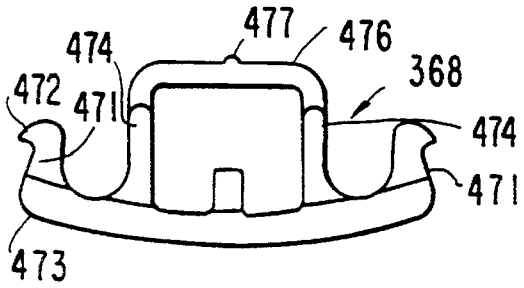
FIGS. 26A, 26B and 26C are side, bottom and cross-sectional views of a locking pawl which may be used in the system of the present invention.
Figure 26B:
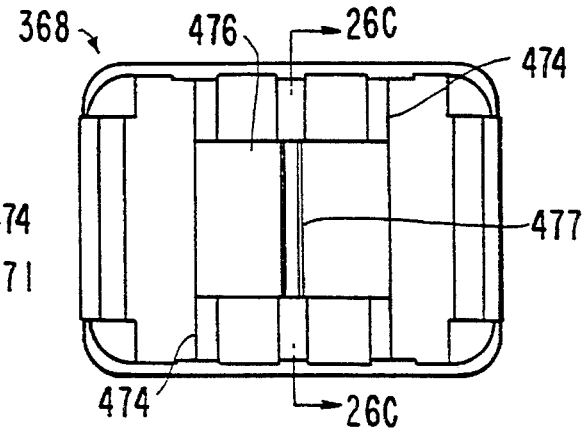
Figure 26C:
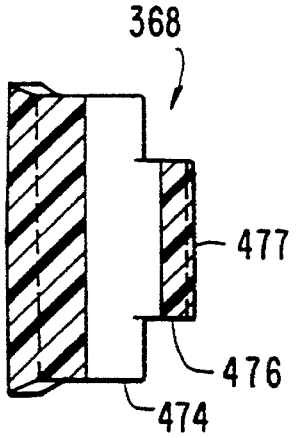

Once swivel elbow 400 is in place, pawls 368 cab be fitted into pawl openings 352 and 353. Pawl 368 is shown in detail in FIGS. 26A (a side view), 26B (a bottom view), and 26C (a cross-sectional view taken along the line shown in FIG. 26B). Pawl 368 includes locking arms 471 with locking teeth 472; locking arms 471 extend from arced base 473. Two spacer walls 474 extend from arced base 473. The upper ends of spacer walls 474 are bridged by bridge 476, with a contact rib 477 extending from bridge 476.

When pawls 368 are inserted into pawl openings 352 and 353, locking teeth 472 lock the pawls 368 in the respective opening 352 or 353. Spacer walls 474 rest snugly between spacing rings 402 and 404 to firmly prevent swivel elbow 400 from being removed from swivel body 340, while still permitting swivel elbow 400 to rotate freely within swivel body.

Figure 27:
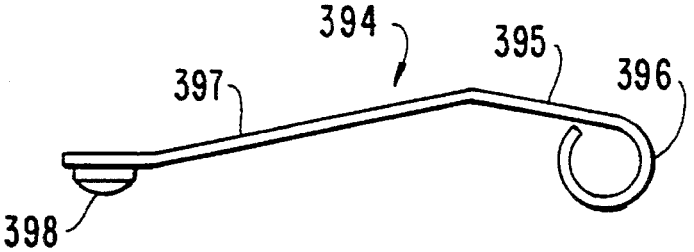
FIG. 27 is a side view of a contact which may be used in the system of the present invention.

As noted above, pins 304 fit into openings 346*a*, 348*a* and 350*a* with flange 306 fitting snugly between low wall 348 and high wall 350. As shown in FIG. 21, swivel contacts 394 are attached to the other ends of wires 390. Swivel contacts 394 are shown in detail in FIG. 27. Swivel contacts 394, which are preferably made of phosphor bronze, include a loop 396, a flat section 395 and a leaf 397. Contact tip 398, which is preferably silver, is attached to leaf 397.

The loops 396 of swivel contacts 394, are then pushed over one-ended pins 392, and the one-ended pins 392 are seated in channel-shaped openings 360*a*, with leaves 397 extending through contact openings 358 into the interior of swivel body 340. Loops 396 are located between angled support walls 360 and flat sections 395 abut angled flats 361 to hold swivel contacts 394 in place. When swivel cover 370 is in place, the lower edges of contact retaining walls 380 will urge flat portions 395 of swivel contacts 394 against angled flats 361 of swivel body 340 which will force the respective contact tips 398 of the swivel contacts 394 to make electrical contact with either the lower or the upper snap ring contact 440. Electrical contact will thus be maintained when swivel elbow 400 is rotated axially within swivel body 340. Although snap ring contacts 440 do not extend entirely around suction tube 401, swivel elbow 400 is prevented by stop wall 356 from rotating into a position in which contact tips 398 will not contact snap ring contacts 440 as described above.

Swivel cover 370 can then be placed onto swivel body 340. Arced tabs 382 of swivel body cover 370 are inserted into arced openings 363 on swivel body 340 and swivel cover 370 is pivoted downward onto swivel body 340. As noted above, the lower edges of contact retaining walls 380 abut the top of the flat portion 395 of swivel contacts 394, to hold them tightly in place to preload swivel contacts 394. Square posts 378 protrude into channel-shaped openings 360*a* in angled support walls 360 and contact pins 304 to hold pins 304 firmly in place. Pins 304 fit into the two semi-cylindrical channels 376 in arced flange 372. Stop wall 374 abuts the inside of low wall 346. A screw (preferably with an accompanying screw cap) is then used to fasten swivel cover 370 onto swivel body 340.

Figure 28:
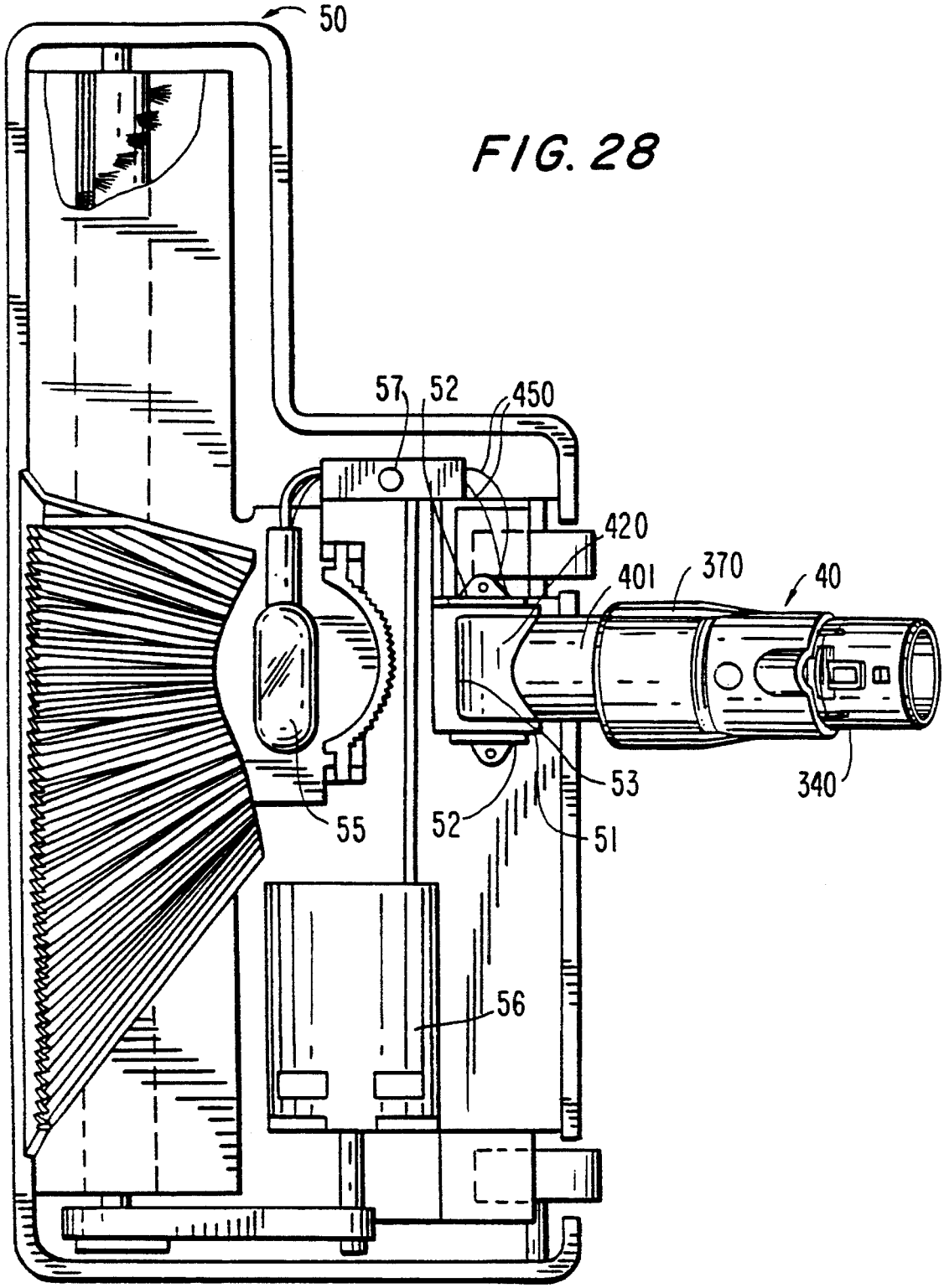
FIG. 28 is a top view of a powered floor nozzle attached to a swivel elbow which may be used in the system of the present invention.

The entire elbow assembly 40 will ordinarily be permanently mounted to powered floor nozzle by means of cylindrical pivot 420 of swivel elbow 400, which is attached to powered floor nozzle 50. The mounting of cylindrical pivot 420 of swivel elbow 400 to powered floor nozzle 50 will be clear to a person of ordinary skill in the art, and may be in accordance with any conventional means known in the art. FIG. 28 shows a top view of a typical powered floor nozzle 50 with its cover removed.

As shown in FIG. 28, a cradle 51 attached to powered floor nozzle 50 surrounds the two circular sides and front of cylindrical pivot 420. Elbow 40 thus pivots either upward/forward or downward/backward when cylindrical pivot 420 rotates within cradle 51. Cradle 51 also includes circular recesses to accommodate the circular rims 422 on the sides of cylindrical pivot 420. These circular recesses cause circular extensions 52 in the side walls of cradle 50. A side view of circular extensions 52 is shown in FIG. 28. Stop ledge 53, which extends back from the front wall of cradle 51, limits the forward pivoting of elbow 40 by abutting the base of suction tube 401 when suction tube 401 is approximately vertical.

Wires 450 (which are attached to snap ring contacts 440 in elbow 40) exit swivel elbow 400 at the bottom of wire channel 410 as described above and are electrically interfaced to bulb 55 and brush motor 56 in any conventional manner.

Switch 22 on handle 20 can thus be used to turn brush motor 56 and light bulb 55 on and off. If the system of the present invention is employed in a canister vacuum, switch 22 may also control the vacuum motor (in which case suction hose 10 may include four conducting wires). The wiring of the bulb 55 and the brush motor 56 may be done in any conventional manner. Powered floor nozzle 50 may, for example, employ a circuit breaker with a reset switch 57 as will be understood by those of ordinary skill in the art.

Elbow 40 thus provides both pivoting movement (via cylindrical pivot 420 and cradle 51) and steering movement (when swivel elbow 400 rotates axially within elbow body 340) while maintaining reliable electrical contact to power powered floor nozzle 50. The steering capability enables the user to more easily maneuver powered floor nozzle 50 around obstacles.

Figure 29A:
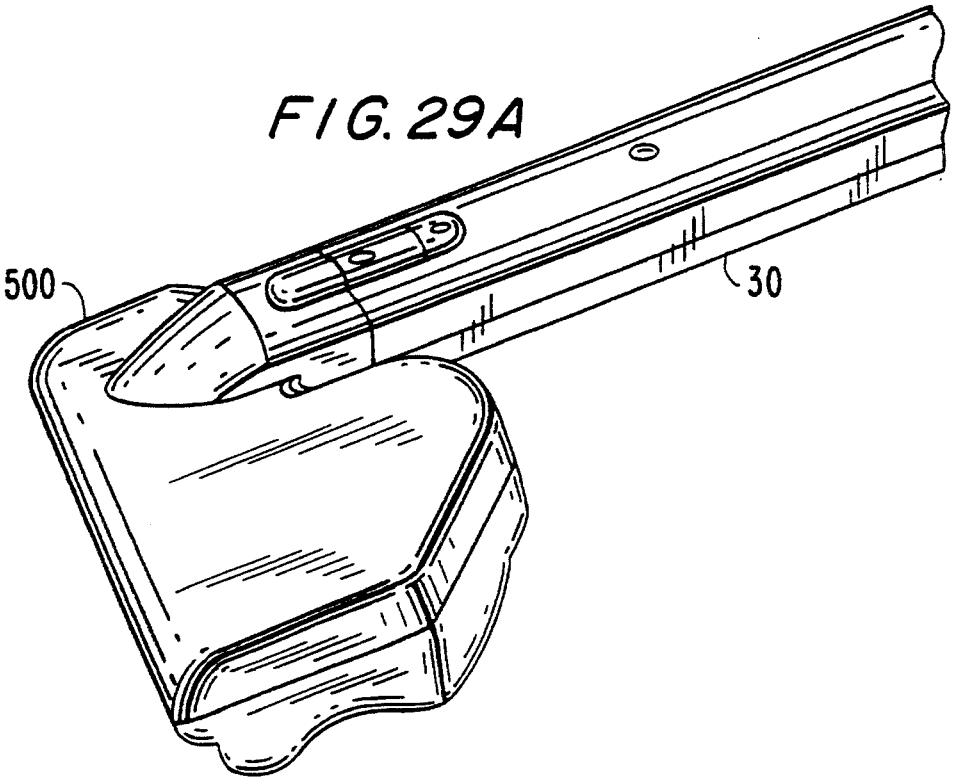
FIGS. 29A, 29B and 29C are perspective, rear and top views of a small powered nozzle which may be used in the system of the present invention.

In addition to powered floor nozzle 50, the handle and wand system of the present invention may be used with several other cleaning tools. As shown in FIG. 29A, a small powered nozzle 500 may be attached to the female end of wand 30 (or even the end of handle 20) for above-the-floor cleaning. Small powered nozzle 500 may be any conventional powered nozzle of the size and design shown in FIG. 29A.

Figure 29B:
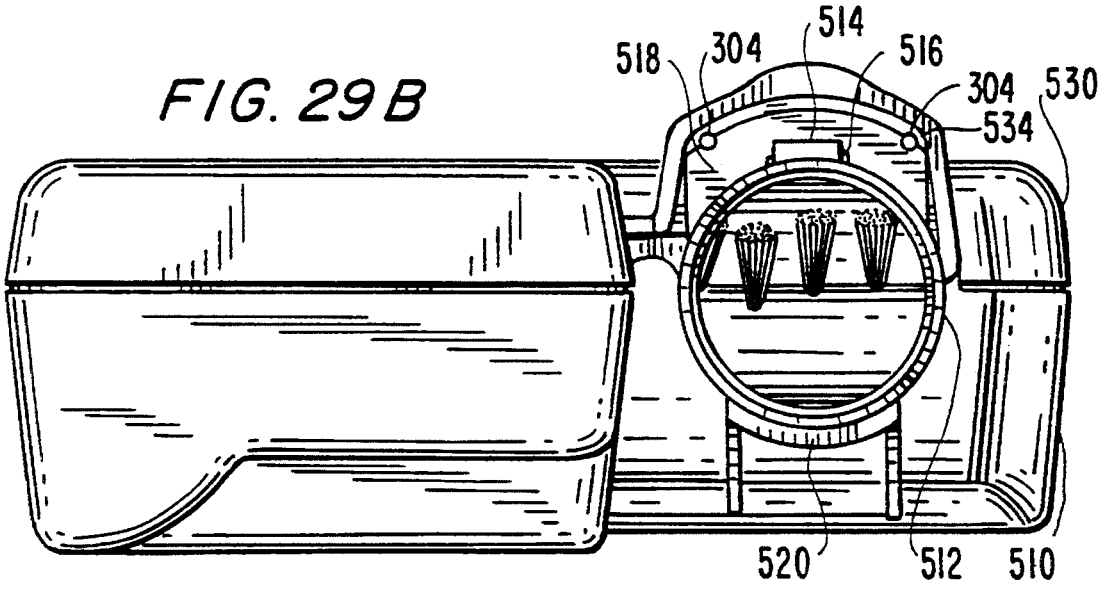
Figure 29C:
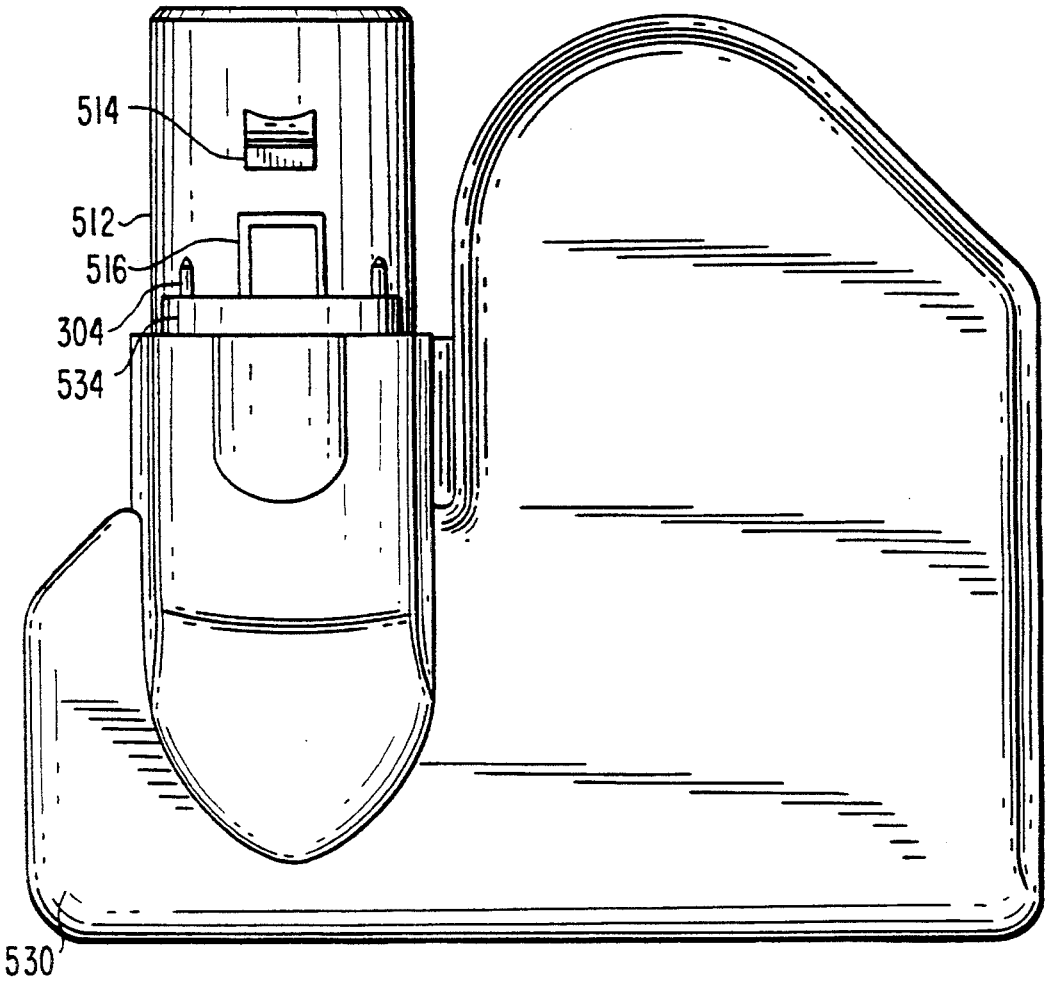

FIGS. 29B and 29C show end and top views of the means for interfacing small powered nozzle 500 to the wand and handle system of the present invention. Small powered nozzle 500 has an interface which is virtually identical to the male end 37 of wand 30, as 10 it must interface with the female end 38 of wands 30. Like the male end 37 of wands 30, small powered nozzle 500 has a nozzle body 510 with a cylindrical flange 512 with a locking projection 514 and an angled key 516. Small powered nozzle 500 also includes a nozzle cover 530, which includes an arced flange 534. Pins 304 are held in openings between arced flange 534 and low wall 518 of nozzle body 510. Pins 304 are held in place in the same manner described above in connection with wand 30. Nozzle body 510 also includes an arced stop wall 520 which serves the same purpose as rim 257 on wand 30.

As can be seen in FIG. 29B, small powered nozzle 500 includes a beater brush which is powered by a conventional motor. Pins 304 make electrical contact with connectors in wands 30 as described above to power small powered nozzle 500.

Figure 30A:
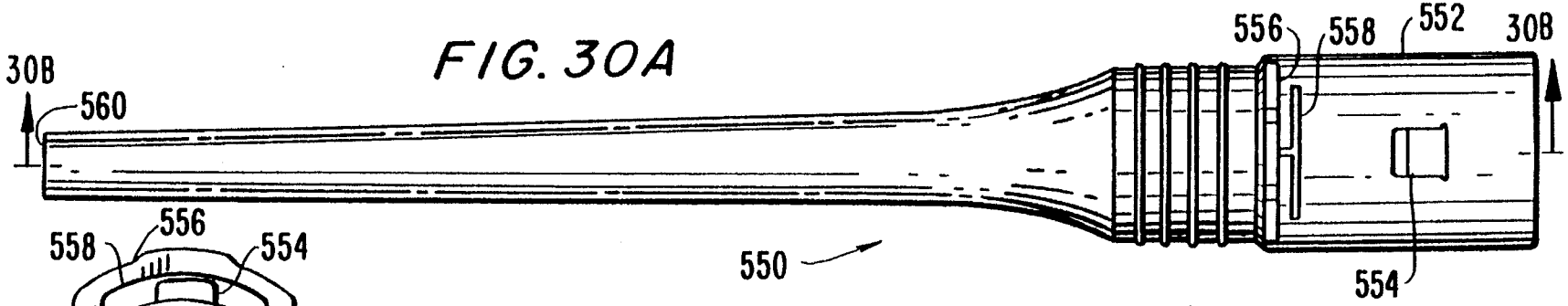
FIGS. 30A, 30B and 30C are top, cross-sectional and rear views of a crevice tool which may be used in the system of the present invention.
Figure 30C:
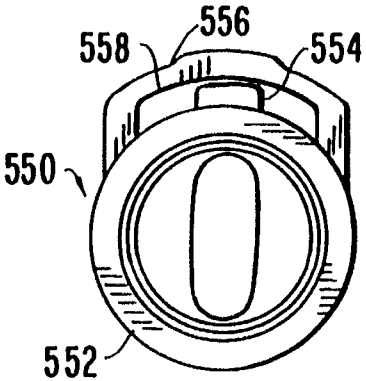
Figure 30B:
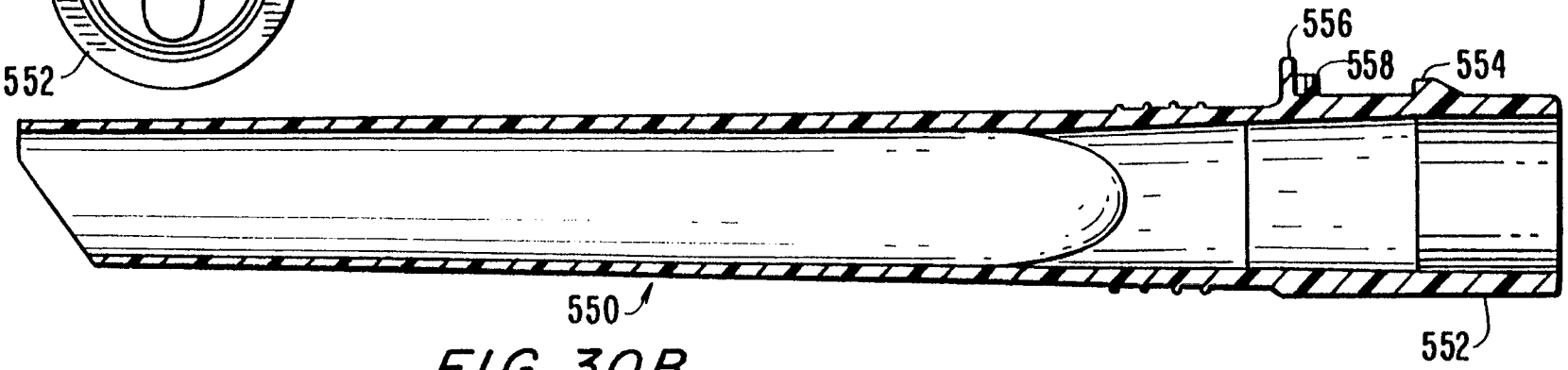

The handle and wand system of the present invention may also use non-powered cleaning tools. For example, a crevice tool 550 is shown in FIGS. 30A through 30C. As shown in the top view of FIG. 30A, crevice tool 550 includes a cylindrical flange 552. A locking projection 554 like locking projection 252 on wands 30 is located at the top of cylindrical flange 552. In front of locking projection 554 are low wall 558 and high wall 556, which are best shown in the cross-sectional view shown in FIG. 30B. Low wall 558 and high wall 556 are also shown in FIG. 30C, which is a view of crevice tool 550 from end having the cylindrical flange 552.

Crevice tool 550 is preferably a single piece molded of ABS plastic. The nozzle end 560 of crevice tool 550 may be configured in an conventional manner known to those of ordinary skill in the art.

When crevice tool 550 is attached to the female end 38 of wand 30, latch 24 locks with locking projection 554 as described above in connection with wand 30. Low wall 558 abuts front wall 274 of wand 30 to hold wand 30 and crevice tool 550 tightly together. The outside of cylindrical flange 552 fits tightly within the female end 38 of wand body 250 to provide a vacuum seal. Shield wall 556 fits within recess formed by extension 295 of wand cover 280 such that the forward side of high wall 556 fits is even with the forward edge of wand cover 280. Shield wall 556 thus shields the openings in wand 30 which provide access to spring terminals 230 (or barrel receptacle 302, if plug connector 610 is employed).

The same interface elements discussed in connection with crevice tool 550 may also be employed to attach other tools to the handle and wand system of the present invention, as will be clear to those of ordinary skill in the art. Furthermore, adapters including the interface elements discussed in connection with the crevice tool 550 may also be employed to interface the handle and wand system of the present invention with cleaning tools which were designed of use with other systems.

Figures 31A, 31B:
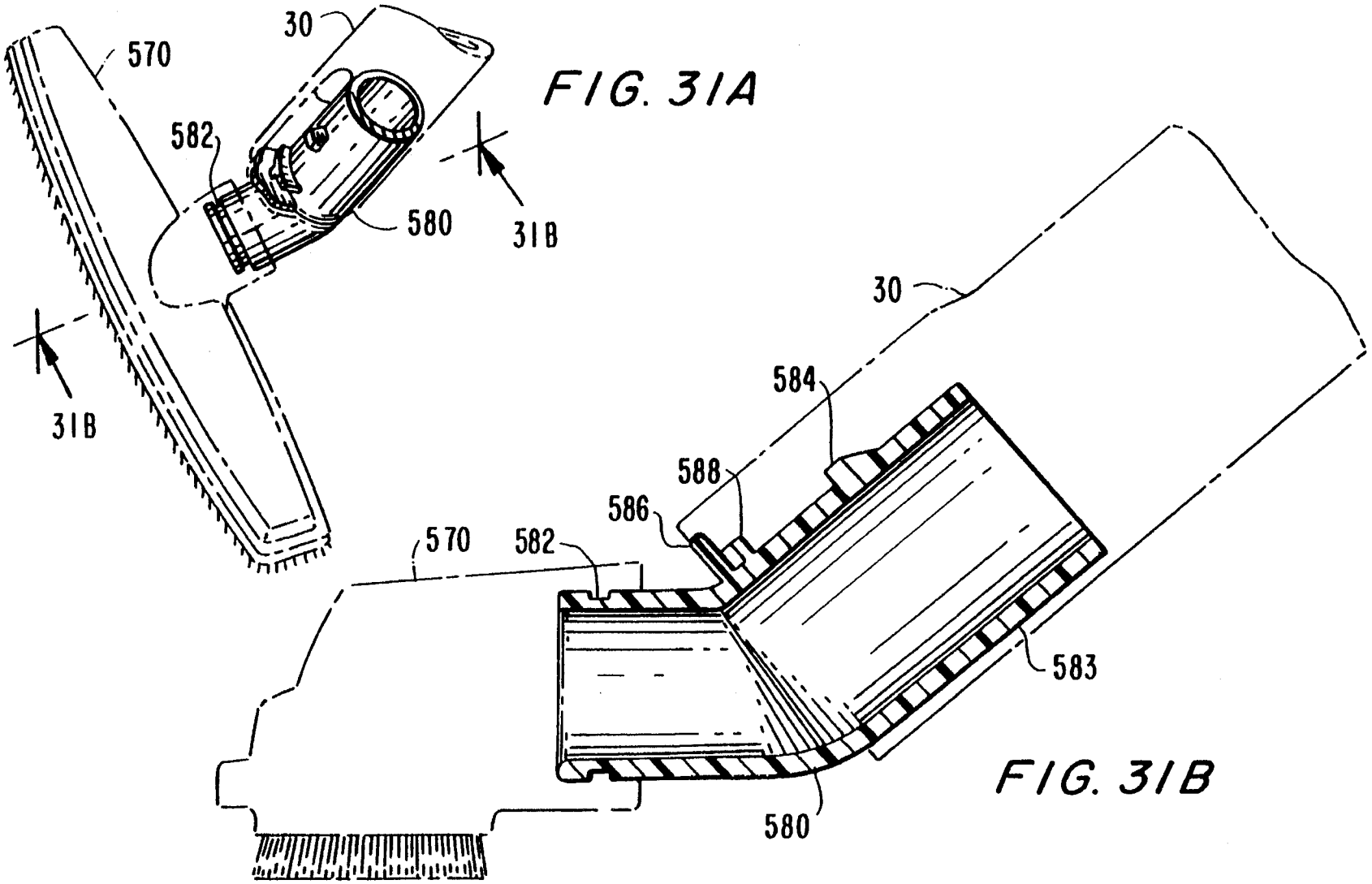
FIGS. 31A and 31B are perspective and cross-sectional view of an angled adapter which may be used in the system of the present invention, with a floor nozzle and a wand shown in phantom lines.

FIGS. 31A and 31B show an exemplary angled adaptor 580 for attaching the handle and wand system of the present invention to any of a number of conventional non-powered floor tools. A typical floor tool is shown in a phantom view in the perspective view of FIG. 31A and in the cross-sectional view of FIG. 31B. Wand 30 is also shown in phantom in FIGS. 31A and 31B.

Angled adapter 580 may be attached to floor tool in any conventional manner. Preferably, angled adapter 580 will include a groove 582 extending entirely around it. Floor tool 570 may then have one or more tabs or other similar structures which seat in groove 582 to lock angled adapter 580 onto floor tool 570 while permitting floor tool 570 to rotate freely about the lower end of angled adapter 580.

Like crevice tool 550, angled adaptor 580 includes a cylindrical flange 583, a locking projection 584, and a low wall 588 and a shield wall 586. Thus angled adaptor 580 can be easily attached and detached from wand 30 (or even handle 20) using latch 24.

Figures 32A, 32B:
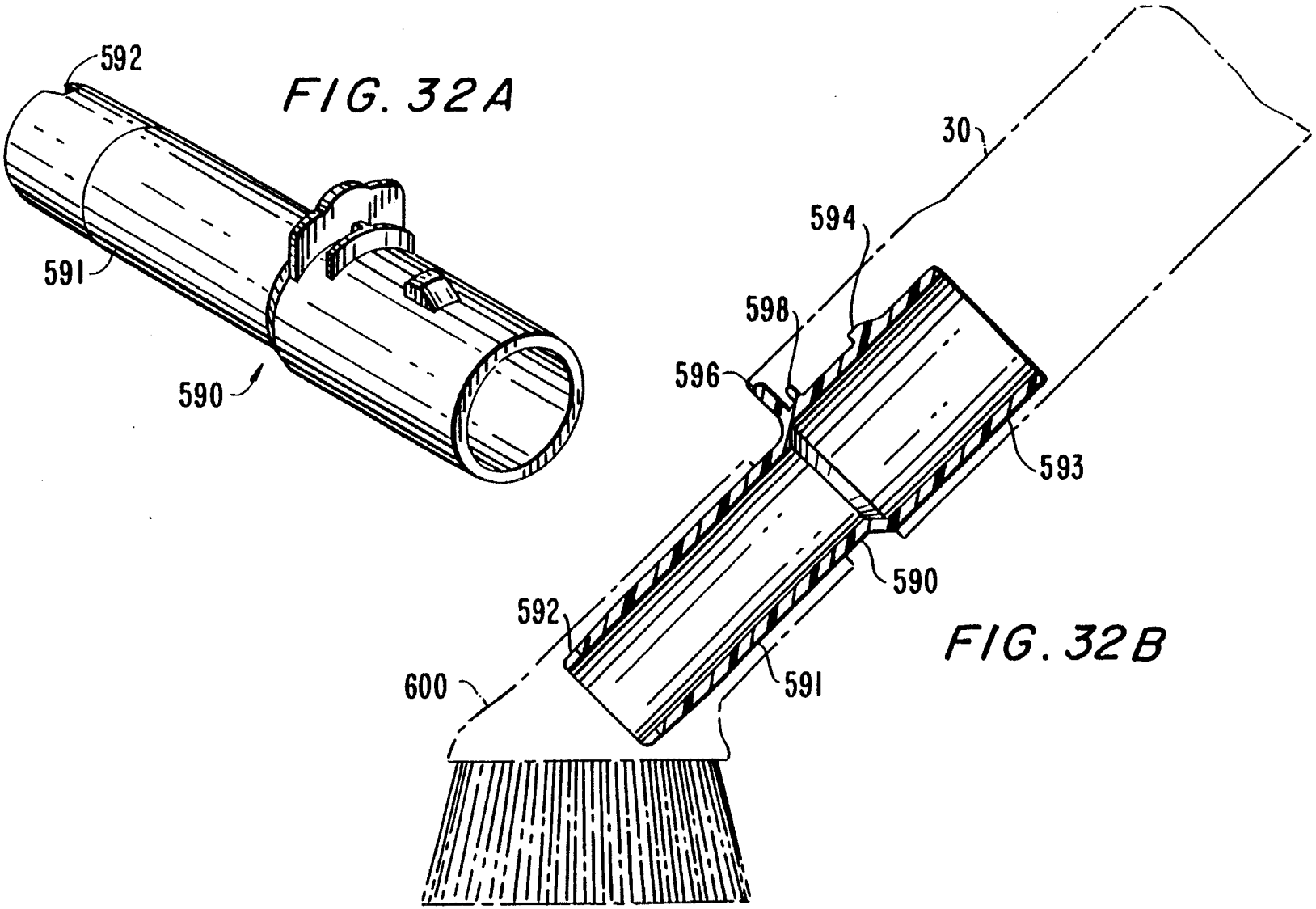
FIGS. 32A and 32B are perspective and cross-sectional views of a straight adapter which may be used in the system of the present invention, with a dusting brush and a wand shown in phantom lines.

FIGS. 32A and 32B show an exemplary straight adaptor 590 which may be employed with other cleaning tools, such as a dusting brush 600, or a dusting brush tool which, when reversed (i.e., by joining the dusting brush end to straight adaptor 590) becomes an upholstery tool. Straight adapter 590 may employ an extended tube 591 and one or more notches 592 or similar structure at its lower end to snap onto dusting brush 600. Like angled adaptor 580, straight adapter 590 also includes a cylindrical flange 593, a locking projection 594, and a low wall 598 and a shield wall 596. Thus straight adaptor 590 can be easily attached and detached from wand 30 using latch 24.

In an alternative embodiment of the handle and wand system of the present invention, spring terminal 230 used in handle 20 and wands 30 may be replaced by an 0.093 barrel receptacle 302 mounted in front pockets 88 and rear pockets 87. This embodiment may provide an even lower contact resistance than the embodiment discussed above employing spring terminal 230.

Figure 33B:
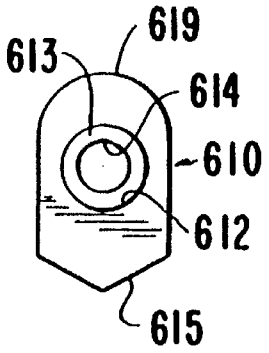
FIGS. 33A, 33B and 33C are cut-away side, front and rear views of a connector plug which may be used in the system of the present invention.
Figure 33A:
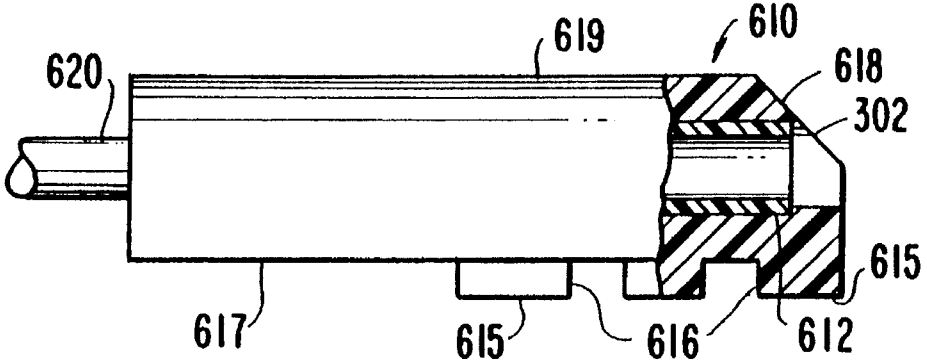
Figure 33C:
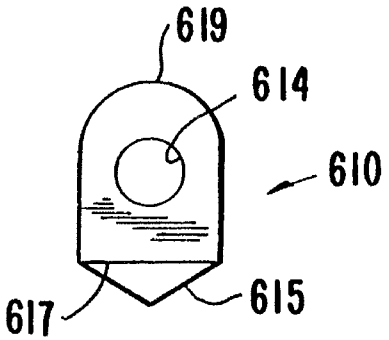

In this alternative embodiment, which is shown in FIGS. 33A through 33C, a plug connector 610 which can be mounted in front pockets 88 and rear pockets 87 includes a wide bore 612 at one end and a narrow bore 614 at the other end. The wide bore 612 (which can be seen in the front end view of plug connector 610 shown in FIG. 33B) is separated from narrow bore 614 (which can be seen in the rear end view shown in FIG. 33C) by rim 613. A barrel receptacle 302 can be mounted snugly in the wide bore 612. Preferably, plug connector 610, which may be vinyl, is molded around barrel connector 302 (with wire 620 already attached). In the side and cut-away cross-sectional view of FIG. 33A, the front, open end of barrel receptacle 302 can be seen.

Barrel receptacle 302 is crimped to wire 620 (shown in FIG. 33A) at one end of plug connector 610. Wire 620 may be any wire in handle 20 (or in wand 30, as will be discussed below) extending from the rear of handle 20 into rear pocket 87. Wire 620 passes out of plug connector 610 through narrow bore 614.

Plug connector 610 includes a "V"-shaped base 615 with two rectangular channels 616 cut therein. "V"-shaped base 615 extends down from the front of plug connector 610. Rear flat 617 runs from the rear end of "V"-shaped base 615 to the rear end of plug connector 610. Plug connector 610 includes rounded top 619, except at the front of plug connector 610, where there is a tapered portion 618.

When connector plug 302 is used in place of spring connector 230, after barrel receptacle 302 and wire 620 are positioned in plug connector 610, "V"-shaped base is put into front pocket 88 (or 270 for wand body 250), into which it fits snugly. Leveling supports 83 (or 271 for wand body 250) fit snugly into rectangular channels 616.

As will be understood by those of ordinary skill in the art, where connector plug 610 is used, the length of angled prongs 110 in handle cover 100 (or of prongs 292 in wand cover 280) will be reduced so as to abut the rounded top 619 of connector plug 610 when handle cover 100 (or wand cover 280) is in place.

One skilled in the art will appreciate that the present invention can be practiced by other than the described embodiments, which are presented for the purposes of illustration and not of limitation, and the present invention is limited only by the claims which follow.

What is claimed is:

1. A swivel joint for joining a powered nozzle to a vacuum cleaner system, the swivel joint comprising:

a swivel member joined at a lower end thereof to a powered nozzle, the swivel member including a tubular section at an upper end of the swivel member, the swivel member also having a suction conduit therein and first and second spacing rings protruding from the outside of the tubular section, with a pair of grooves in the outside of the tubular section being located between the spacing rings;

a pair of snap ring contacts, each of which fits into one of the grooves in the tubular section of the swivel member such that each snap ring contact at least partially encircles the tubular section of the swivel member, each of the snap ring contacts being electrically connected to an electrical system in the powered nozzle;

an elbow body having a bore at a lower end thereof and a suction conduit extending from the bore to an upper end of the elbow body, the upper end of the elbow body including an interface for joining the elbow body to the vacuum cleaner system, the elbow body also having at least one contact opening therein;

a pair of swivel contacts mounted to the elbow body, each swivel contact extending through a particular contact opening into the bore, each swivel contact being electrically connected to the interface at the upper end of the elbow body;

wherein a portion of the tubular section of the swivel member is positioned in the bore of the elbow body with the spacing rings contacting the bore and such that each swivel contact makes electrical contact with a corresponding snap ring contact to permit the swivel member to rotate within the bore while electrical contact between each swivel contact the corresponding snap ring contact is maintained.

2. The swivel joint of claim 1 wherein the swivel member further includes a third spacing ring.

3. The swivel joint of claim 2 wherein the elbow body further includes a pawl opening and the swivel joint further comprises a locking pawl which fits into the pawl opening and extends into the bore between the second and third spacing rings of the swivel member to prevent the swivel member from moving further inward or outward with respect to the bore.

4. The swivel joint of claim 3 wherein the elbow body further includes a bore stop wall extending into the bore from a side wall of the bore.

5. The swivel joint of claim 4 wherein the third spacing ring is located at the upper end of the swivel member, and the swivel member further includes a pair of swivel member stop walls extending upward from the third spacing ring, the swivel member stop walls abutting the bore stop wall when the swivel member is rotated within the elbow body to limit the rotation of the swivel member within the elbow body.

6. The swivel joint of claim 5 wherein the swivel member further includes a pivot mount at a lower end of the swivel member, wherein the pivot mount is joined to the powered nozzle so as to permit the swivel joint to pivot about the pivot mount.

7. The swivel joint of claim 6 wherein the first spacing ring has a gap therein to permit the snap ring contacts to be electrically connected to the electrical system in the powered nozzle.

8. A swivel interface for joining a suction hose having a plurality of conducting wires embedded therein to a handle, the swivel interface comprising:

a tube support having a first end, wherein an end of the suction hose covers the first end of the tube support, the tube support having an outer surface with a plurality of spring contact mounts located on the outer surface;

a plurality of spring contacts, each spring contact including a contact leaf, and each spring contact being mounted to one of the spring contact mounts such that the contact leaf on the spring contact extends radially outward from the outer surface of the tube support, with each spring contact being electrically connected to one of the plurality of conducting wires imbedded in the suction hose;

a hose cuff attached to the suction hose, the hose cuff having a groove extending around an exterior surface of the hose cuff;

a slip ring insulator surrounding a portion of the outer surface of the tube support, the slip ring insulator having a generally tubular configuration with a plurality of contact openings therein, the slip ring insulator being positioned on the tube support such that the contact leaf of each spring contact mounted to the tube support protrudes through one of the plurality of contact openings in the slip ring insulator;

a plurality of conducting slip rings mounted on the slip ring insulator such that each conducting slip ring is in contact with the contact leaf of one of the spring contacts;

a contact board mounted in the handle, the contact board including a plurality of board contacts, each board contact making electrical contact with a conducting slip ring and being electrically connected to an electrical system in the handle; and a tab in the handle extending into the groove in the hose cuff to permit the hose cuff and the suction hose to be rotated relative to the handle, wherein electrical contact between the conducting wires embedded in the suction hose and the electrical system in the handle is maintained when the hose cuff and suction hose rotate with respect to the handle.

9. The swivel interface of claim 8 further comprising a lead insulator separating the ends of the conducting wires embedded in the suction hose from the conducting slip rings.

10. The swivel interface of claim 9 wherein the slip ring insulator has a gap therein, giving the slip ring insulator a generally C-shaped cross-section.

11. The swivel interface of claim 10 wherein the outer surface of the tube support includes a key which fits into the gap in the slip ring insulator.

12. The swivel interface of claim 8 wherein the slip ring insulator has an outer slip ring insulator surface including a plurality of slip ring grooves into which the conducting slip rings seat.

13. The swivel interface of claim 8 wherein the electrical system in the handle includes an on/off power switch.

14. The swivel interface of claim 8 wherein the tube support is plastic.

* * * * *

UNITED STATES PATENT AND TRADEMARK OFFICE

CERTIFICATE OF CORRECTION

PATENT NO : 5,472,346

DATED : December 5, 1995

INVENTOR(S) : Steven L. Gray et al.

It is certified that error appears in the above-identified patent and that said Letters Patent is hereby corrected as shown below:

Column 2, line 3, "attaches" should be -- attached --;

line 15, "Support" should be -- support --.

Column 4, line 9, "a" should be -- an --.

Column 5, line 17, "Harrisburg" should be -- Harrisburg, --.

line 22, "a" should be deleted;

line 48, after "(which" should be inserted -- is --;

line 54, "Which" should be -- which --.

Column 7, line 31, "SA" should be -- 8A --.

Column 10, line 27, "70." should be -- 70). --.

Column 11, line 9, "self tapping" should be -- self-tapping --;

line 23, "glass" should be -- glass- --;

line 34, "73.)" should be -- 73). --.

Column 17, line 8, "below" should be -- below, --;

line 17, "half way" should be -- halfway --;

line 35, "Mass." should be -- Mass., --.

UNITED STATES PATENT AND TRADEMARK OFFICE
CERTIFICATE OF CORRECTION

PATENT NO : 5,472,346

DATED : December 5, 1995

INVENTOR(S) : Steven L. Gray et al.

It is certified that error appears in the above-identified patent and that said Letters Patent are hereby corrected as shown below:

Column 19, line 61, "10" should be deleted.

Column 20, line 14, "554" should be -- 554, --;

line 15, "30" should be -- 30, --;

line 24, "an" should be -- a --;

line 34, "is even" should be -- evenly --;

line 46, "of" should be -- for --.

Column 21, line 31, "cut-away" should be -- cutaway --.

Claim 1, column 22, line 32, after "contact" should be inserted -- and --.

Signed and Sealed this

Twenty-eighth Day of December, 1999

*Attest:*

Q. TODD DICKINSON

*Attesting Officer*

*Acting Commissioner of Patents and Trademarks*